US009696082B2

(12) United States Patent
Pape

(10) Patent No.: US 9,696,082 B2
(45) Date of Patent: Jul. 4, 2017

(54) METHOD AND APPARATUS FOR DISTRIBUTING AND STORING SERIALLY PRODUCED ARTICLES IN MULTIPLE STORAGE UNITS

(71) Applicant: Reddy Ice Technology LLC, Dallas, TX (US)

(72) Inventor: Henrik Pape, Horsens (DK)

(73) Assignee: REDDY ICE TECHNOLOGY LLC, Dallas, TX (US)

( * ) Notice: Subject to any disclaimer, the term of this patent is extended or adjusted under 35 U.S.C. 154(b) by 687 days.

(21) Appl. No.: 13/970,418

(22) Filed: Aug. 19, 2013

(65) Prior Publication Data

US 2014/0033740 A1 Feb. 6, 2014

Related U.S. Application Data

(62) Division of application No. 13/564,999, filed on Aug. 2, 2012, now Pat. No. 8,534,034.

(51) Int. Cl.
*F25D 13/06* (2006.01)
*B65B 43/42* (2006.01)
(Continued)

(52) U.S. Cl.
CPC ..... *F25D 13/06* (2013.01); *B65B 43/42* (2013.01); *B65B 57/20* (2013.01); *B65B 61/28* (2013.01)

(58) Field of Classification Search
CPC ..... F25D 13/06; B65B 43/42; B65B 43/123; B65B 43/22; B65B 43/267; B65B 43/34;
(Continued)

(56) References Cited

U.S. PATENT DOCUMENTS 2,116,300 A 5/1938 Campos
2,272,530 A 2/1942 Patterson
(Continued)

FOREIGN PATENT DOCUMENTS

CN 2150499 Y 12/1993
EP 0459050 A1 12/1991
(Continued)

OTHER PUBLICATIONS

Office Action and Search Report issued on Jan. 20, 2014 for related CN Patent Application No. 201180044860.X, in 10 pages.
(Continued)

*Primary Examiner* — Thanh Truong
*Assistant Examiner* — Thomas Wittenschlaeger
(74) *Attorney, Agent, or Firm* — Haynes and Boone, LLP

(57) ABSTRACT

An apparatus and method for distributing articles is arranged to deliver articles to selected stacking positions in two or more storage units. An article is dispensed to a first article transport and distribution section in a main storage unit, and then either delivered to a stacking position in the main unit or transported through a connecting window onto a second transport and distribution section in a satellite storage unit for delivery to a stacking position in that unit. The procedure is repeated to distribute subsequent bags of ice to selected stacking positions in each unit. Additional satellite storage units may be provided and included in the delivery sequence for distributing bags of ice throughout the units. The storage units may be refrigerated, merchandizing units for bagged ice, with the main storage unit associated with an ice bagged ice supply unit which dispenses bags of ice into the unit.

23 Claims, 16 Drawing Sheets

(51) Int. Cl.
*B65B 57/20* (2006.01)
*B65B 61/28* (2006.01)

(58) Field of Classification Search
CPC ..... B65B 57/20; B65B 61/28; B65B 61/06; B65B 3/06; B65B 1/06; B65B 1/30; B65B 51/146; B65B 63/08; F25C 5/002; F25C 5/18; F25C 5/007; F25C 5/187; F25C 5/00; F25C 5/02; F25C 5/16; F25C 1/00; F25C 2300/00; F25C 2700/02; B65G 69/04; B65G 69/0408; B65G 1/04
USPC ..... 53/440, 127, 459, 469, 570, 284.7, 473, 53/467; 221/119, 218, 253
See application file for complete search history.

(56) References Cited

U.S. PATENT DOCUMENTS 2,322,175 A 6/1943 Talbot et al.
2,334,256 A 11/1943 Eaton
2,582,381 A 1/1952 Higginbottom
2,584,726 A 2/1952 McOmber
2,649,235 A 8/1953 Edmonds
2,669,377 A 2/1954 Poolen et al.
2,777,264 A 1/1957 Schenk
2,986,897 A 6/1961 Howard
3,119,518 A 1/1964 Eschenburg et al.
3,151,668 A 10/1964 Zimmerman
3,211,338 A 10/1965 Weil et al.
3,277,666 A 10/1966 Simmons
3,323,280 A 6/1967 Rausch
3,380,222 A 4/1968 Bergmann et al.
3,416,620 A 12/1968 McClusky
3,488,910 A 1/1970 Stoger et al.
3,498,020 A 3/1970 Eppenberger
3,501,887 A 3/1970 Umholtz et al.
3,559,424 A 2/1971 Nelson
3,608,657 A 9/1971 Johnson et al.
3,608,786 A 9/1971 Shelley et al.
3,610,482 A 10/1971 Van Steenburgh, Jr.
3,618,733 A 11/1971 Winsett
3,626,662 A 12/1971 Graveley
3,654,771 A 4/1972 Kuebler
3,688,471 A 9/1972 Clark et al.
3,698,451 A 10/1972 Hudson
3,712,019 A 1/1973 Lamka et al.
3,715,119 A 2/1973 Shelley et al.
3,719,307 A 3/1973 Larson
3,788,566 A 1/1974 Morris, Jr.
3,789,570 A 2/1974 Mullins, Jr.
3,789,574 A 2/1974 Weikert
3,807,193 A 4/1974 McKenney et al.
3,822,866 A 7/1974 Daester
3,830,266 A 8/1974 Hudson
3,897,676 A 8/1975 Membrino
3,903,674 A 9/1975 Brush et al.
3,913,343 A 10/1975 Rowland et al.
3,918,266 A 11/1975 Gindy et al.
3,969,909 A 7/1976 Barto et al.
3,974,625 A 8/1976 Simmons
3,977,851 A 8/1976 Toya
3,982,377 A 9/1976 Vanderpool
4,013,199 A 3/1977 Brown
4,027,459 A 6/1977 Nieskens et al.
4,056,215 A 11/1977 Zwahlen
4,074,507 A 2/1978 Ruf et al.
4,088,243 A 5/1978 Deveson
4,129,015 A 12/1978 Morris, Jr.
4,132,049 A 1/1979 Mullins, Jr.
4,136,803 A 1/1979 Tobias et al.
4,137,689 A 2/1979 McClusky et al.
4,139,029 A 2/1979 Geraci
4,139,126 A 2/1979 Krasner et al.
4,158,426 A 6/1979 Frohbieter
4,189,063 A 2/1980 Matthiesen
4,252,002 A 2/1981 Mullins, Jr.
4,276,751 A 7/1981 Saltzman et al.
4,320,615 A 3/1982 Gmur
4,348,872 A 9/1982 Hill
4,350,004 A 9/1982 Tsujimoto et al.
4,368,608 A 1/1983 Ray
4,404,817 A 9/1983 Cox, III
4,409,763 A 10/1983 Rydeen
4,420,197 A 12/1983 Dreiling
4,461,520 A 7/1984 Alneng
4,467,622 A 8/1984 Takahashi et al.
4,478,386 A 10/1984 Mikkelsen
4,487,093 A 12/1984 Peroutky
4,522,292 A 6/1985 Euverard et al.
4,527,401 A 7/1985 Nelson
4,534,155 A 8/1985 Sawa et al.
4,587,810 A 5/1986 Fletcher
4,598,529 A 7/1986 Pongrass et al.
4,612,779 A 9/1986 Hatton
4,673,103 A 6/1987 Anderson et al.
4,689,937 A 9/1987 Finan, Sr. et al.
4,715,167 A 12/1987 Savigny
4,732,301 A 3/1988 Tobias et al.
4,803,847 A 2/1989 Koeneman et al.
4,850,202 A 7/1989 Kito et al.
4,878,523 A 11/1989 Balsamico et al.
4,903,494 A 2/1990 Wigley
4,909,696 A 3/1990 Wigley
4,930,685 A 6/1990 Landers
4,942,979 A 7/1990 Linstromberg et al.
4,942,983 A 7/1990 Bradbury
4,979,353 A 12/1990 Seppala
4,981,237 A 1/1991 Landers
4,995,219 A 2/1991 Hicks
5,005,341 A 4/1991 Tetenborg
5,009,060 A 4/1991 Furukawa
5,027,610 A 7/1991 Hara et al.
5,056,299 A 10/1991 Furukawa et al.
5,070,798 A 12/1991 Jurgens
5,079,897 A 1/1992 Muller
5,088,300 A 2/1992 Wessa
5,108,590 A 4/1992 Disanto
5,109,651 A 5/1992 Stuart
5,112,477 A 5/1992 Hamlin
5,211,030 A 5/1993 Jameson
5,277,016 A * 1/1994 Williams ..... B65B 5/067 53/459
RE34,533 E 2/1994 Wigley
5,440,863 A 8/1995 Toya et al.
5,473,865 A 12/1995 Tanaka et al.
5,630,310 A 5/1997 Chadwell et al.
5,722,215 A 3/1998 Yuyama et al.
5,791,123 A 8/1998 Bolz
5,813,196 A 9/1998 Page et al.
5,822,955 A 10/1998 Woosley et al.
5,832,700 A 11/1998 Kammler et al.
6,112,539 A 9/2000 Colberg
6,237,308 B1 5/2001 Quintin et al.
6,282,869 B1 9/2001 Bullock et al.
6,305,177 B1 10/2001 Edwards et al.
6,474,048 B1 11/2002 Metzger et al.
6,725,625 B1 4/2004 Honma et al.
6,862,866 B2 3/2005 Jacobsen et al.
6,904,765 B2 6/2005 Lee et al.
6,904,946 B2 6/2005 James
7,062,892 B2 6/2006 Metzger
7,331,163 B2 2/2008 Hau et al.
7,421,834 B1 9/2008 Doolan
7,426,812 B2 9/2008 Metzger
7,426,945 B2 9/2008 Dalton et al.
7,669,434 B2 3/2010 Leclear et al.
7,681,408 B2 3/2010 Hobson et al.
7,849,660 B2 12/2010 Metzger
7,958,918 B2 6/2011 Ladson
7,992,364 B2 8/2011 Thurgood et al.
8,122,689 B2 2/2012 Pape
8,299,656 B2 10/2012 Allard et al.
8,336,975 B2 12/2012 Allard et al.
8,438,870 B2 5/2013 Leclear et al.

(56) References Cited

U.S. PATENT DOCUMENTS

| | | | | |
|---|---|---|---|---|
| 2003/0000180 | A1 | 1/2003 | Singer | |
| 2004/0216481 | A1 | 11/2004 | James et al. | |
| 2005/0115210 | A1 | 6/2005 | Noumi | |
| 2006/0021300 | A1 | 2/2006 | Tada et al. | |
| 2006/0090427 | A1 | 5/2006 | Hau et al. | |
| 2007/0175235 | A1 | 8/2007 | Metzger | |
| 2008/0047233 | A1 | 2/2008 | Metzger | |
| 2008/0110129 | A1 | 5/2008 | LeBlanc et al. | |
| 2008/0283145 | A1 | 11/2008 | Maxwell | |
| 2008/0295462 | A1* | 12/2008 | Metzger | F25C 1/00 53/469 |
| 2009/0003981 | A1* | 1/2009 | Miller | B65G 1/04 414/267 |
| 2010/0011710 | A1 | 1/2010 | Pape | |
| 2010/0024363 | A1 | 2/2010 | Pape | |
| 2010/0263335 | A1 | 10/2010 | Pape | |
| 2010/0268375 | A1* | 10/2010 | Pape | B65G 69/0408 700/218 |
| 2010/0313524 | A1 | 12/2010 | Pape et al. | |
| 2012/0070264 | A1* | 3/2012 | Pape | B65B 3/06 414/794.4 |
| 2013/0255194 | A1 | 10/2013 | Metzger | |

FOREIGN PATENT DOCUMENTS

| | | | |
|---|---|---|---|
| EP | 1123884 | A1 | 8/2001 |
| EP | 1696192 | A1 | 8/2006 |
| FR | 2650559 | A1 | 2/1991 |
| GB | 1459629 | A | 12/1976 |
| GB | 2011633 | A | 7/1979 |
| JP | H1-33455 | | 10/1989 |
| JP | H2-41067 | | 3/1990 |
| JP | 05132007 | A | 5/1993 |
| WO | 0001582 | | 1/2000 |
| WO | 2008089762 | A1 | 7/2008 |

OTHER PUBLICATIONS

International Search Report mailed on Apr. 4, 2008 for PCT/DK2008/000027 (5 pages).

* cited by examiner

METHOD AND APPARATUS FOR DISTRIBUTING AND STORING SERIALLY PRODUCED ARTICLES IN MULTIPLE STORAGE UNITS

RELATED APPLICATION

The present application is a divisional of U.S. patent application Ser. No. 13/564,999 filed on Aug. 2, 2012 and entitled Method and Apparatus for Distributing and Storing Serially Produced Articles in Multiple Storage Units, which is hereby incorporated by reference.

FIELD OF THE INVENTION

The present invention concerns an automated bagged ice system and method which bags ice and distributes the bagged ice made by series production into storage compartments or units, and is particularly concerned with a method of distributing bagged ice into two or more adjacent freezer compartments or units for storage and dispensing purposes.

BACKGROUND OF THE INVENTION

Articles manufactured by series production, particularly packaged bags of ice such as bagged candy, bagged ice cubes, and the like, are often dispensed into a storage unit. Machines for making ice and delivering bags with loose ice cubes may be deployed in supermarkets. Such machines are designed with a top part with an ice cube machine and a central packing machine packing the ice cubes loosely in bags, and a lower part with a storage compartment or area for bagged ice from which the filled ice cube bags are supplied as the customer opens an access door to the storage compartment, providing himself with a desired number of ice cube bags. Examples of such machines are described in the applicant's patent application WO 2008/089762 and U.S. Pat. No. 8,122,689 issued on Feb. 28, 2012.

One problem with such machines is that the bags fall down into the storage compartment over the same position. Over time, a stack of bags forms a pyramid. This causes the storage compartment to be badly utilized as it can only be partially filled, resulting in low capacity for a storage compartment of a given size. The pyramid of stacked bags rapidly reaches the top of the compartment in times of low ice demand, so now bags cannot be added until some are removed for purchase. However, when demand for ice is high, for example on public holidays or in hot weather, the storage compartment rapidly empties and the ice bagging machine cannot keep up with the demand. This requires manual refill by store personnel, and sometimes bagged ice must be delivered to the store and manually moved into the freezer compartment to provide sufficient ice to meet customer demand.

The manual leveling and manual refilling is a problem due to work safety considerations that limit the time in which the employees are allowed to work with frozen products, and a desire to release the employees' resources for other purposes in the supermarket.

SUMMARY OF THE INVENTION

It is the object of the invention to provide a method and an apparatus that evenly distributes articles, in particular bagged ice, into two or more storage compartments or units, particularly in bagged ice merchandizers or freezer units in a supermarket, as well as other applications involving distribution of serially produced articles into a main storage unit and one or more satellite storage units.

In one embodiment, a method of distributing serially produced articles such as bags of ice into a main storage unit and one or more satellite storage units stored side-by-side with the main storage unit is provided. The main storage unit and any adjacent storage unit share a dividing wall or walls through which a connecting window is provided. Articles are dispensed one by one from an article dispenser associated with the main storage unit onto a first section of an article carrier and transport assembly in the main storage unit and are either discharged from the first section into a storage area in the main storage unit or transported from the first section onto a second section of the article carrier and transport assembly in an adjacent satellite storage unit via the connecting window, and then discharged from the second section into a storage area in the satellite storage unit. Articles are dispensed into the storage areas of the main and satellite storage compartments or units based on detected space availability and a controlled article discharge sequence. There may be multiple satellite storage units on opposite sides of the main storage unit each communicating with the adjacent storage unit via a connecting window, and each having an additional section of the article carrier and transport assembly on which articles can be supported and transported to a selected discharge position in the respective unit before the article is driven off the platform and into the underlying storage area.

According to another aspect, an apparatus for distributing serially produced articles such as bags of ice is provided, which comprises a main storage unit and one or more satellite storage units stored side-by-side with the main storage unit. The main storage unit and any adjacent storage units have a dividing wall or adjacent side walls through which a connecting window is provided. Each unit has a storage area for holding multiple articles for retrieval by customers. An article transport and distribution assembly has sections in each storage unit and is configured to transport articles to discharge positions in each unit and to transport articles from the section in one unit to the section in an adjacent unit. Each article transport and distribution section has an article discharge device configured to discharge articles from the platform into the storage area of the respective storage unit. The transport and distribution section in the main storage compartment is configured to selectively position an article adjacent to a connecting window to an adjacent storage unit so that an article can be conveyed onto the transport and distribution section in the adjacent compartment and transported to a selected storage location in that compartment. In one embodiment, the articles are bags of ice and the storage units are freezers or refrigerated storage units, and the article dispenser is configured to dispense bags of ice serially onto the carrier section in the main storage unit. A controller is connected to the sections of the transport and distribution assembly in each storage unit and controls the storage unit and storage location into which each dispensed article is discharged.

In one embodiment, the article dispenser may be an ice making and bagging machine mounted on top of the main storage unit or combined with the main storage unit into a single unit. In an alternative embodiment, the article dispenser may be an ice bagging machine which is designed to place measured amounts of pre-made ice cubes or pieces into bags which are then dispensed serially onto the first section of the article transport and distribution assembly. In one embodiment, the article transport and distribution assembly comprises a series of conveyor drive sections in each storage unit, each carrying an article carrier or platform and configured to move the platform back and forth above the storage area in that unit and up to the connecting window or windows to transfer bags of ice from the article carrier or platform in one unit onto the article carrier in an adjacent unit. Additional conveyor sections may be provided in each connecting window to convey bags of ice from one article carrier to the article carrier in the adjacent unit.

In one embodiment, articles are received on the platform in the main storage unit in a first orientation in which one side of the article faces upwards, and the article distributor or discharge device is actuated to convey the article off an end of the platform so that the article turns over as it rotates off the end of the platform with an opposite side of the article facing upward when the article falls into the storage area. This helps to position all articles in a stack in the same orientation, for example with a label facing upwards. The article distributor or discharge device may be a conveyor belt associated with the platform which is actuated to drive articles off the platform.

In one embodiment, each storage unit has a storage area of predetermined dimensions sufficient for storage of two adjacent rows of stacking positions for receiving adjacent stacks or piles of articles, and the article transport and distribution section in the respective unit is configured to distribute articles into any selected stacking position in either row in the unit or through a connecting window into an adjacent storage unit. The control system or controller is configured to control operation of the article transport and distribution assembly to dispense articles into at least two adjacent article rows in each storage unit, so that the heights of stacks of articles in each row are relatively uniform and space in the storage compartments or units is efficiently utilized. One or more detectors may be positioned for detecting the height of the article stacks at each stacking position in the two side-by-side article rows and a drive control module associated with the drive devices determines the sequence for selection of the stacking position and storage unit for dispensing or discharging of each article according to the following steps:

- detecting degree of filling in each stacking position in the two side-by-side rows of stacking positions in each storage compartment;
- comparing degrees of filling;
- selecting a storage unit and article discharge position on the basis of the comparison, so that articles are discharged or dropped into stacking positions having a lower degree of filling. Detectors may be located on the article carriers or platforms in each storage unit in order to collect information on the current degree of filling of the stacked rows of articles at each stacking position as each carrier is driven back and forth by the respective transport and distribution section in the respective unit.

One of the satellite units adjacent the main storage unit in one embodiment is a cart storage unit designed to hold one or more wheeled carts positioned below the transport and distribution section in that unit. Articles such as bags of ice are transported onto the section in the cart storage unit and then distributed from the transport and distribution section into a cart. Once the cart is full, a door on the front of the cart storage compartment is opened and the cart can be wheeled out and transported to a refrigerator or freezer unit in the back of the store, and replaced with a new, empty cart. This allows large quantities of bagged ice to be stored easily and used to re-stock storage units at times of high demand, without needing to have extra bagged ice delivered in trucks or to have store personnel unload bags of ice one by one into carts to transport the ice from the truck to the bagged ice merchandizer or storage units in the store. This reduces re-stocking expense and store personnel time in handling bagged ice.

The apparatus and method may be used in adjacent, upright bagged ice storage cabinets installed in supermarkets where the ice cubes are made in situ according to need, and are packed immediately into bags, before being distributed into a temperature controlled main storage unit associated with the ice cube machine or into an adjacent satellite unit. This arrangement considerably increases storage capacity for bagged ice into one or more adjacent satellite storage compartments or units in addition to the main storage compartment or unit.

The apparatus and method can be applied to other types of machines than bagged ice distribution machines, where a large number of bags of ice are produced centrally above a first or main storage unit in which the bags of ice are to be evenly distributed in order to utilize the capacity of the storage unit. This apparatus and method allows for distribution of such articles into adjacent, satellite storage units or into wheeled carts in an adjacent storage unit, considerably increasing storage capacity and making it easier for store personnel to re-distribute articles to other locations in a store. Examples of such applications could be in connection with a plastic injection molding machine where a large number of articles are produced centrally, or in connection with packing and supplying other types of foods, e.g. vegetables or confectionery.

In connection with systems where one or more users take articles from the storage units, the degree of filling at the stacking positions may be different due to the fact that the articles are taken from the stacking positions at different rates. By actively detecting the degree of filling in the individual stacking positions and adapting the sequence of selecting stacking positions in plural storage compartments on the basis of a comparison of the degrees of filling in each stacking position, a leveling that takes account of user interaction may be achieved. The capability of stacking articles in two side-by-side rows in each storage compartment further increases the storage capacity.

In a particularly simple way there is hereby achieved the ability of dispensing articles into selected stacking positions in a main storage unit and one or more adjacent satellite units.

DESCRIPTION OF THE DRAWINGS

The invention will be explained in more detail below with reference to the accompanying drawings, where.

In the explanation of the Figures, identical or corresponding elements will be provided with the same designations in different Figures. Therefore, no explanation of all details will be given in connection with each single Figure/embodiment.

DETAILED DESCRIPTION

Certain embodiments as disclosed herein provide a method and apparatus for distributing and storing articles from an article production machine into predetermined article stacking positions in article storage areas in a main storage unit and one or more satellite storage units from which consumers can retrieve one or more articles. In the illustrated embodiment, the article production machine is ice making and bagging machine and the apparatus is bagged ice distribution and storage apparatus, with each storage unit comprising a freezer compartment, and includes a bagged ice transport and distribution system designed to discharge or distribute the bags at selected locations in the main and satellite units so as to achieve a relatively even distribution of stacked bags of ice throughout all the freezer compartments.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

In the illustrated embodiment described below, the article distribution and storage apparatus is used to transport ice in bags to selected positions above storage areas in main and satellite storage units having a freezer or temperature controlled compartment, and to discharge or distribute the bags into stacks in the storage area. However, it will be understood that the same apparatus may be used in other applications, for example in any serial production application where a large number of articles are produced centrally above a main storage compartment and the articles are evenly distributed through the main storage compartment and one or more satellite compartments in order to utilize the capacity of multiple storage compartments. Examples of such applications could be in connection with a plastic injection molding machine where a large number of articles are produced centrally, or in connection with packing and supplying other types of foods in bags or other containers, e.g. vegetables or confectionery.

Figure 1:
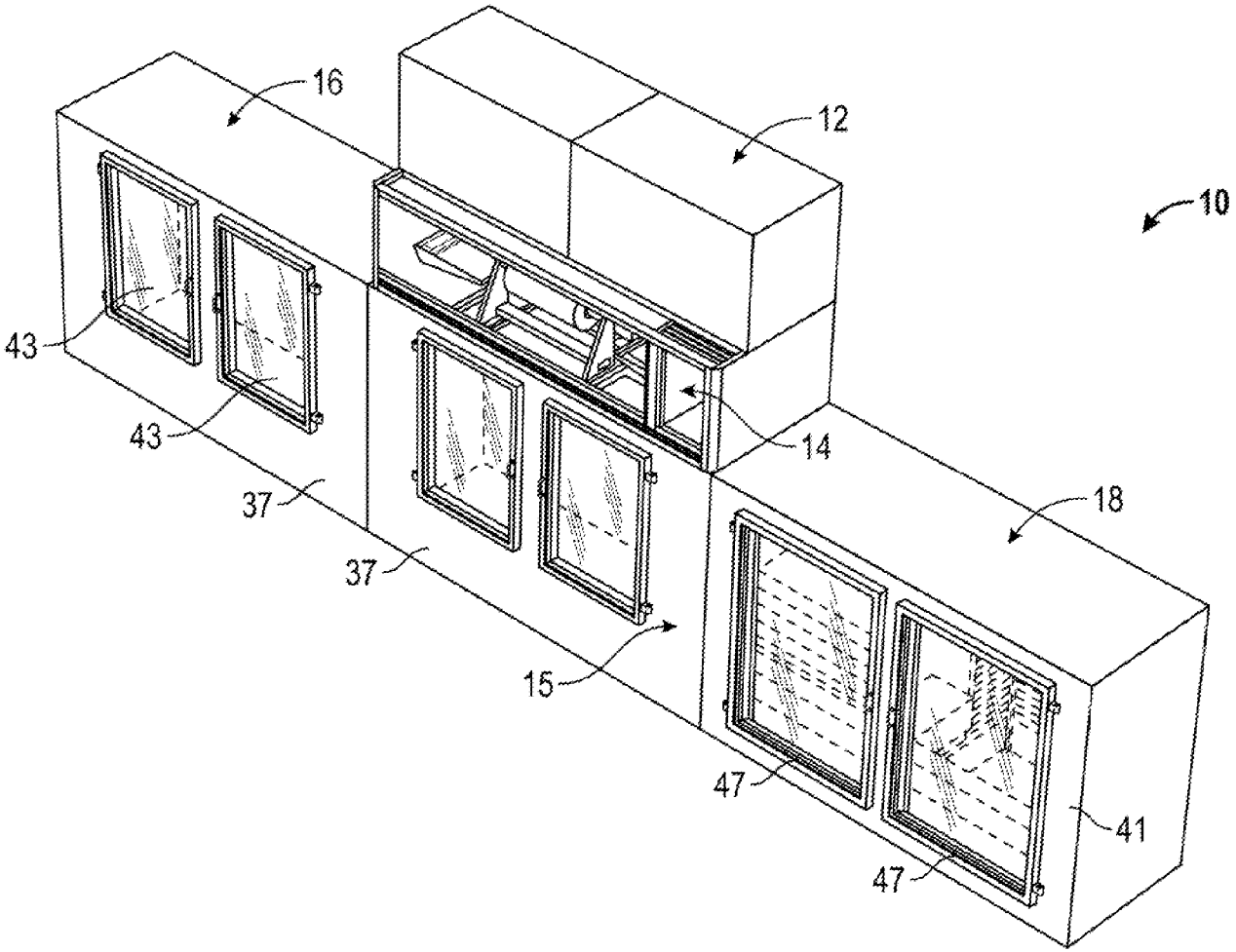
FIG. 1 is a front perspective view of one embodiment of a bagged ice distribution and storage apparatus.

FIGS. 1 to 9 illustrate one embodiment of a bagged ice distribution and storage apparatus or system 10. As illustrated in FIG. 1, apparatus 10 has an upper, ice making unit 12, an ice collecting and bagging unit or bagged ice dispenser 14, a main storage unit 15 beneath the bagged ice dispenser, an additional, satellite storage unit or satellite unit 16 on one side of the main storage unit 15, and a modified satellite storage unit or satellite unit 18 on the opposite side of the main storage unit. In the illustrated embodiment, satellite unit 18 is a cart storage unit designed to receive bagged ice into two wheeled carts or baskets, as described in more detail below. Although the illustrated system has an ice making and bagging machine associated with the main storage unit, other types of ice bagging machines, for example machines for bagging pre-made ice cubes or pieces of ice and dispensing the bagged ice, may be used in place of units 12 and 14 of FIGS. 1 to 9. Additionally, although the illustrated embodiment has a main storage unit and two satellite units, other embodiments may include a greater or lesser number of storage units dependent on the desired storage and merchandizing capacity, for example only one satellite unit 16 or 18 on one side of unit 15, or additional satellite storage units added on to unit 16, unit 18, or both. Storage units 15 and 16 are similar to standard, upright bagged ice merchandizers or freezers used in grocery stores or the like, apart from the article or bagged ice transport and distribution assembly and associated control system incorporated in the units and described in more detail below. Storage unit 18 also incorporates a bagged ice transport and distribution section similar to the other units and is further modified to allow wheeled carts or baskets 45 to be pushed into the storage unit and removed from the unit as needed, as described in more detail below in connection with FIGS. 6 to 8.

The ice collecting and bagging unit or dispenser 14 may be similar to that described in U.S. Pat. No. 8,122,689 issued on Feb. 28, 2012, the entire contents of which are incorporated by reference herein. Ice making machines or units, which are conventional and are not described in detail, are located in the ice making unit or housing 12, and dispense ice in cubes or pieces into ice collectors 13 which direct the ice in a transport path towards a bag making station 17, where the ice is collected into partially formed bags which are then sealed (see FIG. 2). Sealed bags 20 containing ice are dropped through an opening 22 into the storage area 24 of storage unit 15, as described in more detail below. The bagged ice transport and distribution assembly described herein replaces the bag distributor unit described in U.S. Pat. No. 8,122,689, and includes transport and distribution sections 25, 26, 30 mounted in an upper part of the temperature controlled storage areas of the respective storage units 15, 16 and 18. Section 25 is located in a suitable position to collect bags of ice dispensed from the ice collecting and bagging unit 14, as illustrated in the drawings.

Second section 26 is substantially identical to section 25 and is mounted in an upper part of the temperature controlled storage area 28 of satellite storage unit 16 in alignment with section 25, as best illustrated in FIGS. 2E to 2I and 3. The third, substantially identical transport and distribution section 30 is in alignment with the first two sections and is mounted in an upper part of the temperature controlled storage area 32 of storage unit 18, as best illustrated in FIGS. 2I, 6A, 6B, 7A and 7B. The transport and distribution sections may be of the same or different lengths, dependent on the dimensions of the storage compartment. Each transport and distribution section may be the same as the single transport and distribution system as described in U.S. Pat. App. Pub. No. 20120070264, the entire contents of which are incorporated herein by reference.

Figure 3:
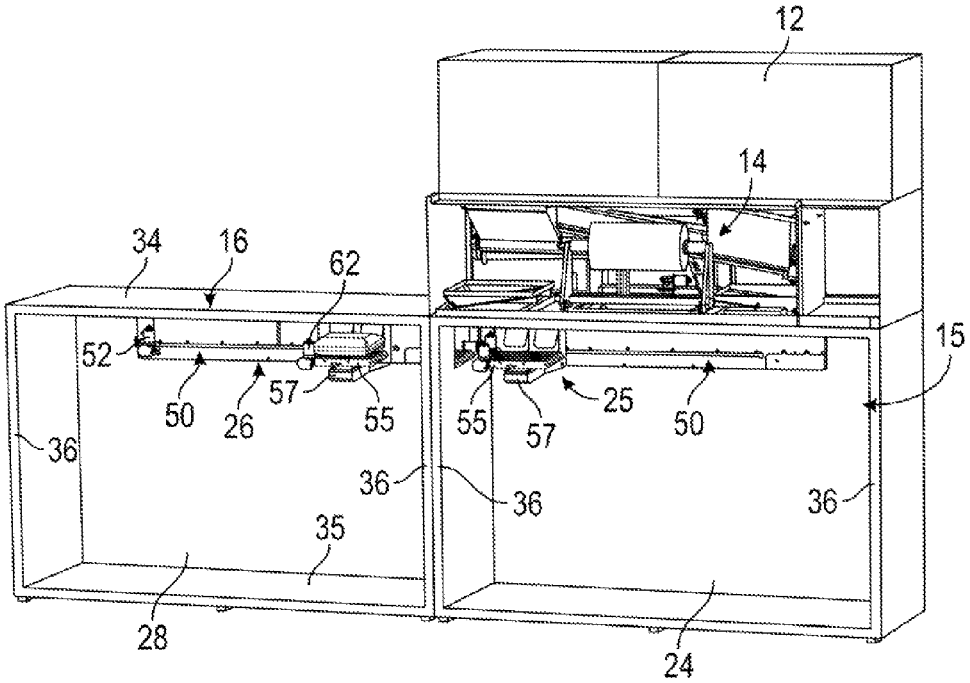
FIG. 3 is a front elevation view of the main storage unit and one satellite unit with the front walls removed to reveal the interior of the storage compartments and both article support platforms and the associate transport conveyors.

As illustrated in FIGS. 1 and 3, each storage unit 15, 16 has an upper wall 34, lower wall 35, opposite side walls 36, and front wall 37. Storage unit 18 is slightly longer than the units 15, 16 and also has an upper wall 38, lower wall 39, opposite side walls 40, and a front wall 41. Access doors 43 are provided in the front wall of each storage unit 15, 16 for customer access to retrieve and purchase bags of ice. Larger access doors 47 are provided in the front wall 41 of the larger, cart storage unit 18. The doors may all be glass doors so that customers and store personnel can see the products stored in the storage units, e.g. bags of ice in this embodiment. Although the storage units are formed separately and secured together side by side with adjacent side walls in the illustrated embodiment, they may be formed integrally with a single divider or wall between adjacent storage areas in alternative embodiments.

Figure 9:
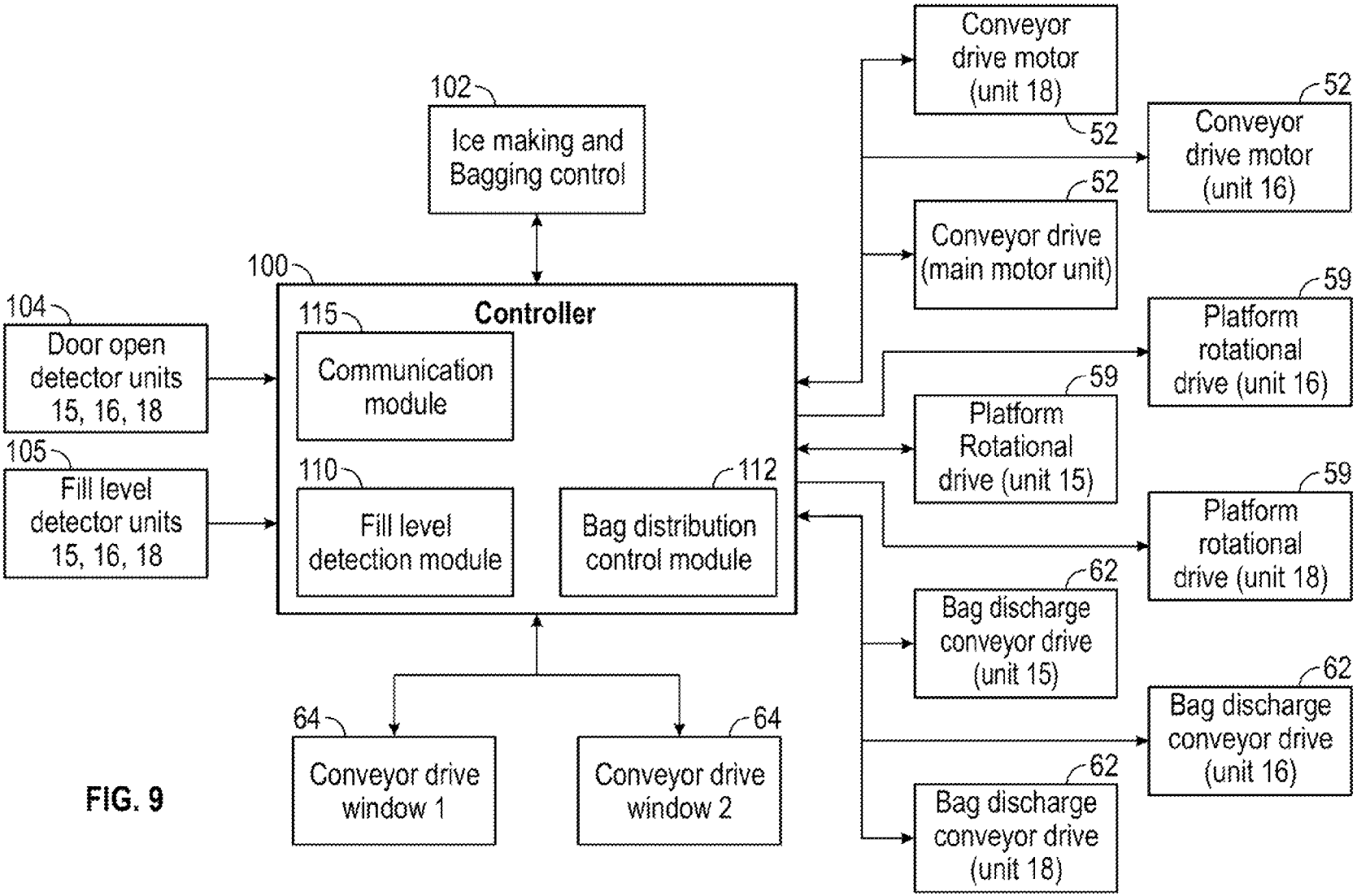
FIG. 9 is a block diagram illustrating one embodiment of a control system for controlling operation of the bagged ice distribution and storage apparatus of FIGS. 1 to 8.

As best illustrated in FIGS. 2A to 2I and 3, a connecting window or opening 42 is provided through the dividing wall or walls between the storage area of main storage unit 15 and satellite storage units 16 and 18. Windows 42 extend through abutting side walls 36 of units 15 and 16 and abutting side walls 36 and 40 of units 15 and 18 in the illustrated embodiment. The connecting windows are aligned with the transport path defined by the transport and distribution sections 25, 26 and 30 in the respective storage units. It will be understood that similar windows are provided for any additional satellite storage units abutting storage units 16 or 18. The transport and distribution assembly of the apparatus further comprises a driven conveyor section or window conveyor 44 mounted in each connecting window to transport bags of ice from one storage unit to the adjacent unit, as described in more detail below. A control system as illustrated in FIG. 9 and described in more detail below controls operation of the ice collecting and bagging unit 14 and the bagged ice transport and distribution assembly or system.

Figure 5:
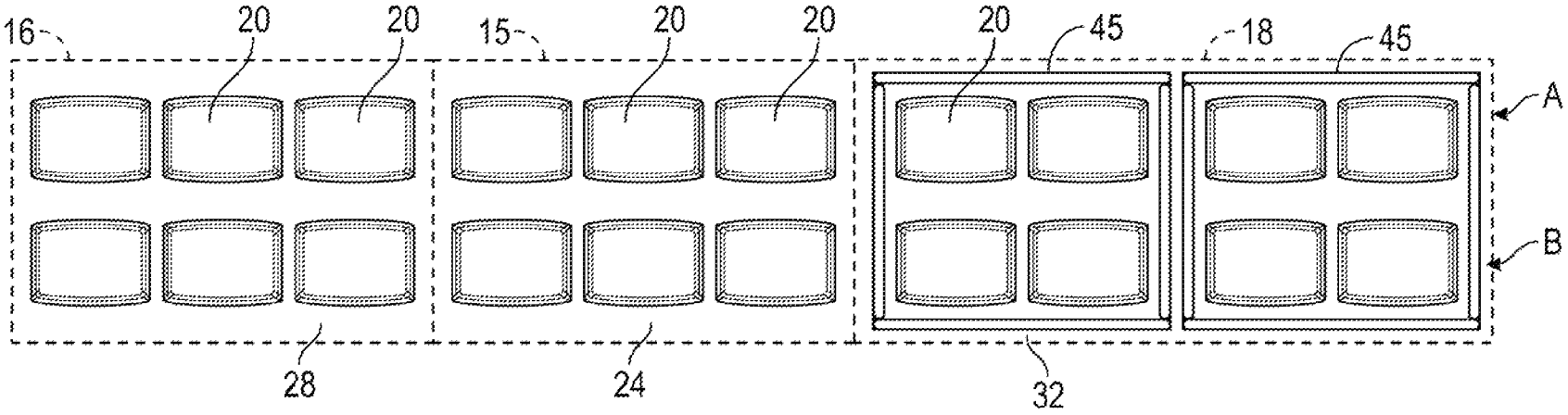
FIG. 5 is a top plan view of the storage areas in the main and satellite storage units illustrating the bag stacking positions in each area.

In one embodiment, the transport and distribution system or assembly is configured to transport and distribute bags of ice into stacks arranged at predetermined stacking positions in two or more rows in each storage area. In the illustrated embodiment, each storage unit is designed for storage of bags 20 of ice in orderly stacks at selected positions in two rows extending between the side walls, as seen in FIG. 5, with the rows in cart storage unit 18 being located in two, side-by-side wheeled carts or baskets 45 in the storage area 32. In this embodiment, six stacks of bagged ice are arranged in each of the storage units 15 and 16, and four stacks of bagged ice are arranged in each cart in storage unit 18, but a greater or lesser number of stacks may be provided in storage units in other embodiments, depending on the size of the storage unit and the dimensions of the bags of ice. The transport and distribution system has a transport path which extends over the innermost row of stacking locations or positions in each unit, and can discharge bags of ice into stacking positions in that row and in the outer row of each unit, as described in more detail below.

The transport and distribution section in each storage unit is more or less identical to the other sections, although the sections may be of different lengths if the storage units are of different widths, and like reference numbers are used for like parts of each section 25, 26, and 30. In this case, transport and distribution section 30 is longer than sections 25 and 26 to allow for the additional stacking position in each row in unit 18, but operates in exactly the same manner as the other two sections to transport and distribute bags of ice. In one embodiment, each transport and distribution section 25, 26, 30 is a conveyor section as illustrated in FIGS. 2A to 4, and basically comprises a horizontal conveyor 50, a carriage 54 mounted on the conveyor and movable back and forth in a horizontal direction on the conveyor, drive motor 52 which operates conveyor 50 and drives carriage 54 back and forth along the horizontal path defined by conveyor 50, and a bag or article support platform or carrier 55 rotatably mounted on carriage 54 for rotation between two or more possible orientations for distributing bags into the storage area, as described in more detail below. Other types of bag transport and distribution devices may be used in alternative embodiments.

Figure 2A:
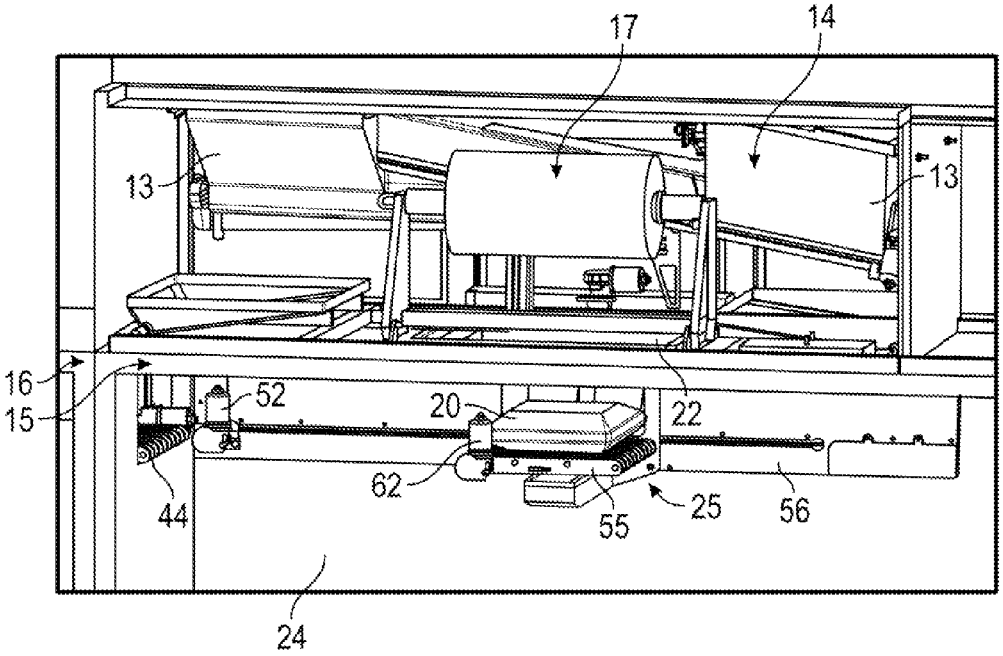
FIG. 2A is a front perspective view of part of the main storage unit of FIG. 1, with the front wall removed to reveal one embodiment of a first section of an article transport and distribution assembly mounted in an upper portion of the main storage compartment for receiving bags of ice from an ice making and bagging unit mounted above the main storage unit.
Figure 4:
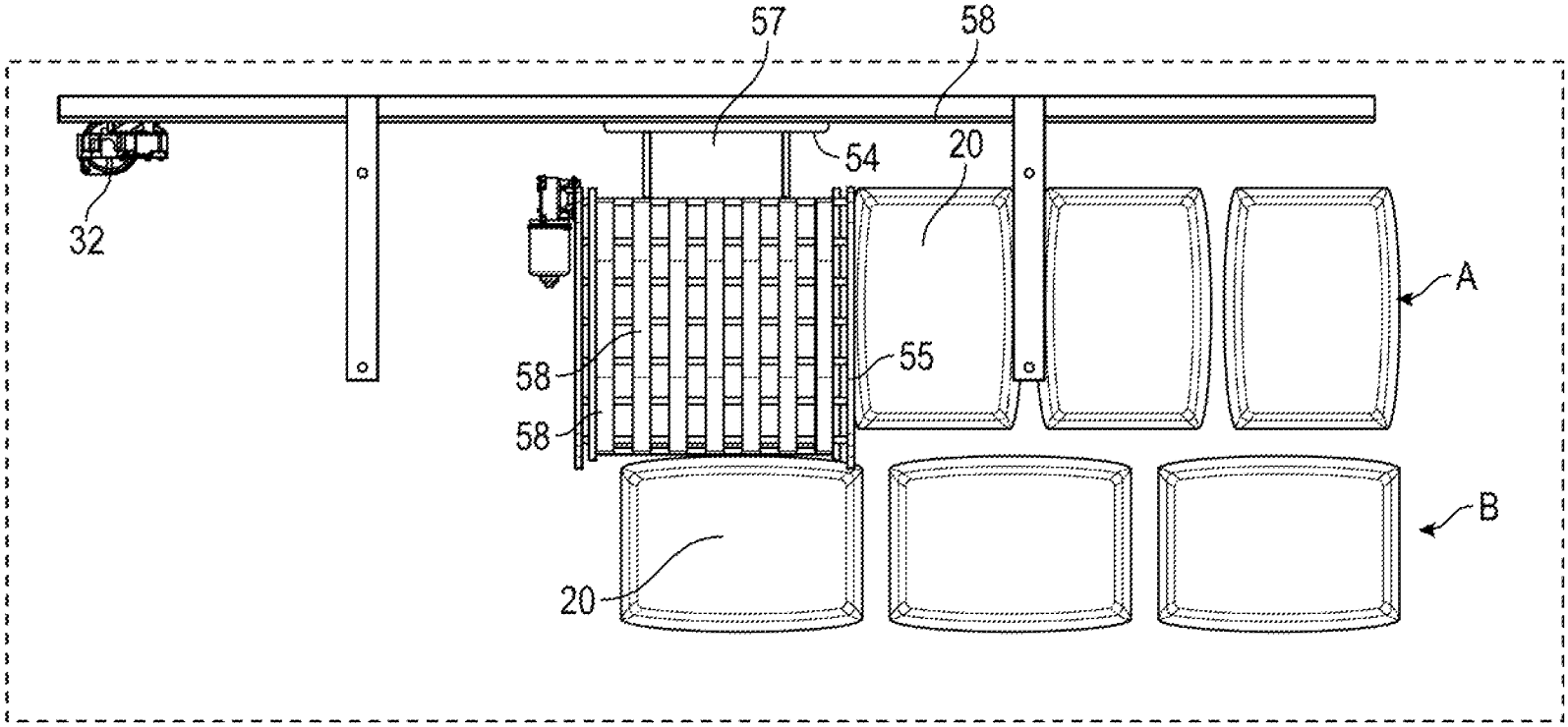
FIG. 4 is a top plan view of the conveyor and bag distributing or discharge platform above the storage area in the main storage unit, with the platform rotated into a second position for distributing bags into an outer row.

The horizontal conveyor 50 comprises a back plate or mounting plate 56 having a rail or track 58 on which the carriage 54 is slidably mounted, and an endless conveyor belt or chain extending around rollers at opposite ends of the track 58, with the carriage 54 suitably linked to the chain in a known manner (not visible in the drawings but described in detail in US Pat. App. Pub. 20120070264 referenced above). Motor 52 drives one of the rollers which acts as a drive roller for the conveyor belt. Article or bag support platform 55 is rotatably mounted on a horizontal extension or support arm 57 of carriage 54 via a pivot connection, as described in US Pat. App. Pub. 20120070264 referenced above. Platform 55 is rotated by platform drive or gear motor 59 (not visible in FIGS. 2A to 3, illustrated in FIG. 9) between a first orientation aligned with the inner row of stacking positions, as illustrated in FIGS. 2A to 3, and a second orientation in which it faces outwardly from track or rail 58 for distributing bags into the outer row of adjacent bag stacking positions in the base or lower wall of the storage compartment, as seen in FIG. 4.

An article conveyor or discharge device is associated with platform 55 and comprises conveyor belt or belts 58 driven by conveyor drive or motor 62 to convey bags or other bags of ice selectively off opposite ends of the platform and into the inner or outer row A, B of stacked bags in the storage unit, depending on the orientation of the platform when the conveyor belts 58 are activated. Article conveyor 58, 62 also acts to convey bags off the platform and onto the conveyor section 44 in one of the connecting windows 42 between storage units when a bag is to be distributed into one of the other storage units. Conveyor belts 58 extends around guide rollers or wheels (not visible) at opposite ends of platform 55 and one of the rollers is selectively driven in opposite directions by the bag or discharge conveyor drive or gear motor 62. In alternative embodiments, the article conveyor may be a pusher device or the like rather than a conveyor belt on which the article is carried. The opposite ends of the bag conveyor 58 are rounded, as illustrated in FIGS. 2A to 2F, which tends to overturn bags of ice as they are dropped off the conveyor, as described in more detail in U.S. Pat. App. Pub. 20120070264 referenced above.

Figure 10:
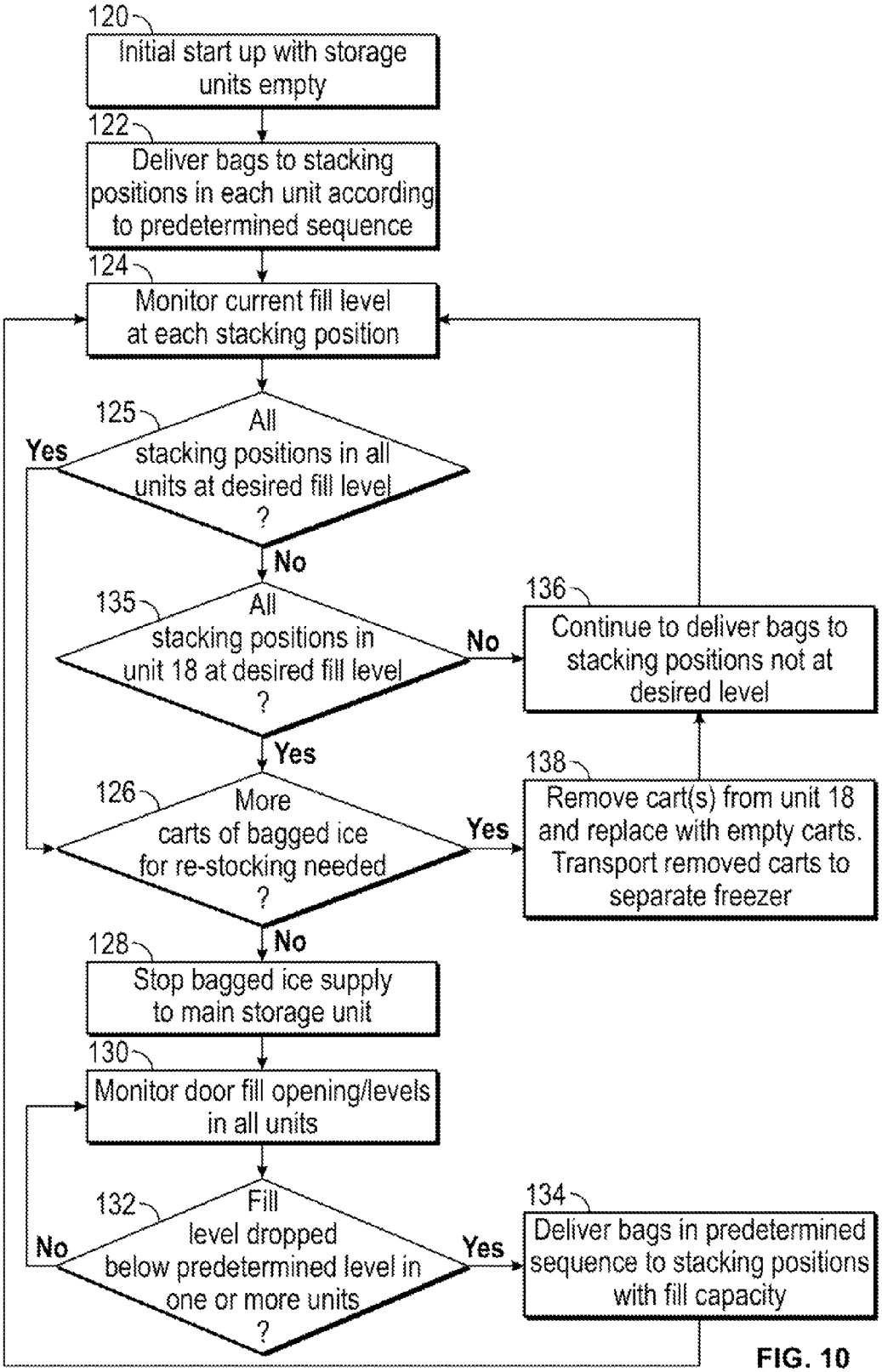
FIG. 10 is a flow diagram illustrating one embodiment of a method of controlling operation of the bagged ice distribution and storage apparatus of FIGS. 1 to 9.

Each conveyor section 44 mounted in a respective connecting window or opening 42 is driven by a respective conveyor drive motor 64 to drive bags through the window and onto the platform 55 in one of the satellite storage units, as illustrated in FIGS. 2D to 2H and described in more detail below. FIG. 9 is a functional block diagram which illustrates one embodiment of a control system for controlling discharge of bags into selected stacking positions in each storage unit in a programmed sequence, while FIG. 10 is a flow diagram illustrating one embodiment of a method of controlling bag transport and distribution throughout the storage unit. The control system is similar to that described in Pat. App. Pub. 20120070264 referenced above, but with additional control functions to accommodate control of the additional transport and discharge conveyor sections and the window conveyor sections.

As described in Pat. App. Pub. 20120070264, various fill level detectors 105 may be located in each of the storage units to detect the height of stacked bags in the two storage rows, as described in more detail below. The detectors may be associated with each of the conveyors and the drive devices to provide input to a controller so that the carriage and platform can be moved to the desired positions based on programming of the controller and input from the various detectors, as discussed in more detail below. Additional fill level detectors may be positioned on the walls of the storage compartments to detect bag height in each of the bag receiving positions in each row. The doors 43, 47 of each storage compartment may be provided with door open detectors 104 to detect when a door is opened.

At the start of a bag distribution procedure, the platform 55 of main storage unit 15 is located in a start position beneath opening 22 to receive a bag of ice 20 (see FIG. 2A). When a bag falls onto platform 55, operation of the transport and distribution assembly is controlled by controller or processor 100 to transport the bag to a selected discharge location and distribute the bag into a selected stacking position in the selected storage unit. Operation of the components of units 12 and 14 are controlled and coordinated by ice making and bagging controller or control unit 102. The ice making and bagging controller 102 is described in U.S. Pat. No. 8,122,689 referenced above and incorporated herein by reference, and reference is made to that patent for a detailed description of controller 102. The main storage unit 15 may be associated with a different bagged ice distribution system for delivering bags of ice onto platform 55 in alternative embodiments.

The storage compartments or units 15, 16 and 18 in the illustrated embodiment each have two side-by-side rows A, B of bag storage positions A1, A2, A3 . . . , etc. and B1, B2, B3 . . . . , etc, in the base of the compartments, as illustrated in FIG. 5. A greater or lesser number of storage positions and storage rows may be provided in alternative embodiments, depending on the dimensions of each storage compartment. In one embodiment, the control system illustrated in FIG. 9 is programmed to control the sequence of bag dropping into the storage positions so as to maintain the height of stacked bags at each storage or stacking position at a desired fill level, and may be arranged to maintain stacks in each unit at approximately the same height or level. When carts 45 are at the desired fill level, they may be removed and replaced with empty carts, and the removed carts are then wheeled to a freezer unit at the back of the store, where they can be kept for re-stocking purposes at times of high ice demand, as discussed in more detail below.

Controller 100 of FIG. 9 has a fill level detection module 110 which is programmed to periodically monitor the height of stacked bags at each storage position based on input from detectors 105 as the transport and distribution system is controlled to distribute bags 20 along the inner and outer rows of each storage unit, and to calculate the positions with the lowest fill level, and a distribution control module 112 which controls the horizontal conveyor drive motors 52, platform rotational drive motors 59, and the platform or bag discharge conveyor drive motors 62 of each conveyor section 25, 26, 30, as well as the drive motors 64 of the window conveyor sections 44 between adjacent conveyor sections, to drive each bag to a selected drop or discharge position above a storage position selected based on the current fill level information from module 110. Detector information for use in selection of the next discharge position may be gathered both as the bag is being driven to a currently selected bag discharge position, and in periodic detection sequences in which the platform is driven along the entire length of each row while empty. In one embodiment, the objective is leveling of the multiple bag stacks. Different storage positions may have an order of preference such that when different storage positions have about the same fill level or are empty, the controller selects a discharge position using the order of preference. A communication module 115 is also incorporated in controller 100, and is configured for wireless communication via the Internet or via cellular link with a local or remote administrator or central office which can selectively monitor operation of the system and receive and store system data, as well as providing control input and notifying maintenance personnel if service is needed.

Door opening detectors 104 as illustrated in FIG. 9 may be associated with the doors for detecting opening of the doors, as described in U.S. Pat. No. 8,122,689 referenced above. The controller 100 also monitors the number of times a door is opened and may initiate a fill level detection sequence if the bag is opened more than a predetermined number of times within a certain time period, and may also provide a control signal to ice making and bagging controller 102 increase the speed of the ice making, bag making and bag filling procedure in times of increased purchase of bagged ice, for example during holiday seasons and in hot weather. Controllers 100 and 102 are also configured to switch off the ice making, collecting and bagging as well as the bag transport and distribution system under some circumstances, such as when all storage units are at a desired fill capacity and no more restocking carts of ice are needed. The controller 102 also stops distribution into any unit having an open door since bags should not be dropped into a storage unit while a customer is retrieving one or more bags of ice from the unit, as well as when the storage unit is at a desired fill capacity at each bag stacking position.

In one embodiment, each detector 105 may be a proximity or distance detector such as an infra red (IR) sensor, a photoelectric sensor, or the like which detects the height of successive stacks of bags in each of the rows and provides the height or fill level information to the controller 100, which stores the information and also determines a current bag drop sequence based on the fill level information. The detector may simply detect whether or not a stack of bags is at the maximum desired height, or may determine distance to the top of a stack, so that the controller or processor 100 can determine if a storage position is completely empty, as well as the approximate bag stack height or amount of fill of the stack. In the latter case, the controller may be programmed to control the bag distribution to maintain the stacks as level as possible, i.e. dropping bags at selected locations to keep the stack heights relatively even. The sensors may be provided on the platform support arm 57 and may be positioned so that stack heights at aligned positions in both rows in each unit may be determined simultaneously.

The sensing sequence for detectors 105 with the arrangement of bag drop positions in FIG. 5 is ten sensor outputs corresponding to the ten bag drop positions in each row of the three storage units, with two outputs at each sensor output position, i.e. a total of twenty sensor outputs. The lowest points detected are stored and sent to controller 100 for determining the bag delivery and distribution sequence. In one embodiment, the bag delivery sequence is controlled to drop bags at the lowest detected positions from the previous sensing sequence. Sensing may be performed during bag distribution and also whenever a predetermined number of door openings is detected. In one embodiment, an initial fill sequence may be designed for filling to the desired level in each of the storage units in sequence, or for filling the rows in all units together in a fill sequence. When all three storage compartments are completely empty, the sequence may be A1, A2, A3 . . . AN, followed by B1, B2, B3 . . . BN, referring to FIG. 5, where N is the total number of bag stacking positions in each row and the positions are numbered A1, A2, . . . and B1, B2, . . . etc starting from the left hand side (satellite unit 16). In alternative embodiments, other initial sequences may be used, such as A1, B1, A2, B2 . . . and so on, or A1 . . . AN, BN . . . B1, or alternatively unit 15 may be stocked to the desired level first (A4, A5, A6, B4, B5, B6 . . . ), followed by unit 16 and then unit 18. Alternatively, the carts in cart storage unit 18 may be stocked prior to unit 16 and replaced with empty carts to provide additional bagged ice stored in the back of the store for subsequent re-stocking purposes at an earlier time.

As noted above, the degree of filling of the individual bag storage or stacking positions is detected by one or more detectors when a bag is being carried to a drop position or when a scan is made with the platforms 55 empty, or both, as described above. If there are any low stacking positions, the re-fill sequence may follow the same basic preference or order as described above. For example, say positions A3, A6, B1 and B4 are detected to be empty or partially empty, or lower than other stacking positions and if they are all at the same fill capacity, the fill sequence may be A3, A6, B1, B4, A3, A6, B1, B4, and so on until each position is at the desired fill level, unless other positions are detected to be completely or partially emptied in the meantime, in which case the other positions are simply added to the sequence. The lowest detected position receives bags before any other position.

A first bag is deposited at a first bag stacking position in the selected sequence, then a second bag at the second position, and so on until bags are removed by customers or each position is stacked with bags to the desired height or fill level, i.e. the compartments or storage units are stocked to a desired capacity. When all storage units are stocked to the desired capacity, carts 45 in unit 18 may be removed for storage in a rear freezer unit at the back of a store, and replaced with empty carts, and the process may continue as long as desired to stock additional carts with ice, returning to re-stock the main and satellite storage units when the levels drop in those units due to purchase of bags of ice by customers. At times of low demand, the ice making and bagging unit 14 and bag transport and distribution system may be turned off once sufficient bags of ice are stored in the store freezer unit, and turned on again when bags have been removed for purchase and re-filling is required. The bag delivery sequence is adjusted to avoid distribution into any storage compartment or unit having a detected open door until the door is closed, so that bags are not dropped into the freezer compartment when a customer is attempting to remove one or more bags of ice for purchase.

Figure 2B:
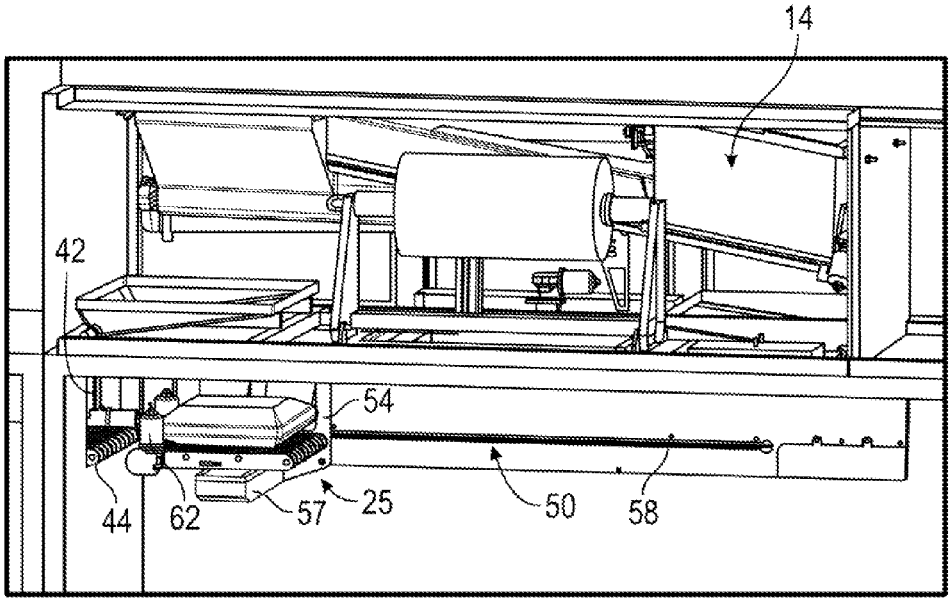
FIG. 2B is a front perspective view similar to FIG. 2A but illustrating the article support platform of the first transport and distribution section in a different position adjacent a window communicating with a first satellite storage unit located on a first side of the main storage unit.
Figure 2C:
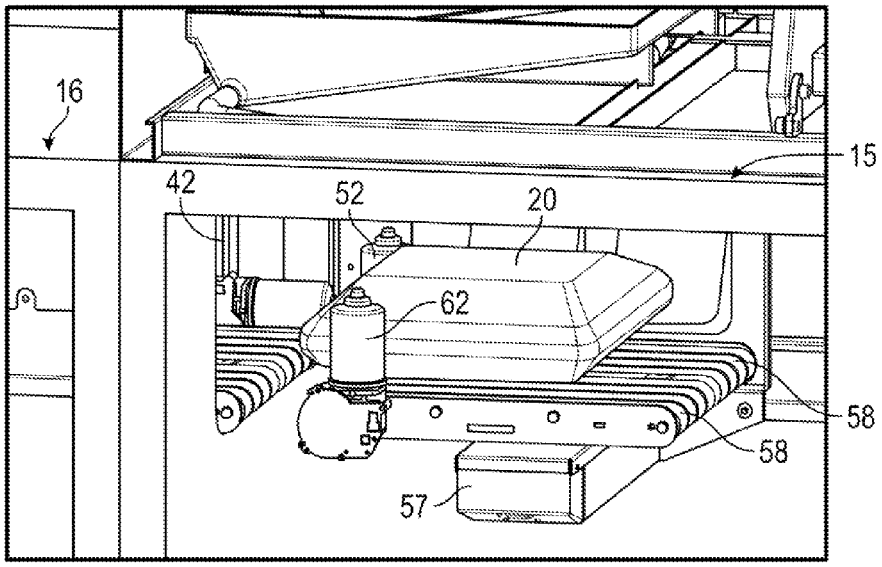
FIG. 2C is an enlarged view of the article support platform and window of FIG. 2A, illustrating an article conveyor on the article support platform and the article conveyor in the connecting window to the adjacent storage unit.
Figure 2D:
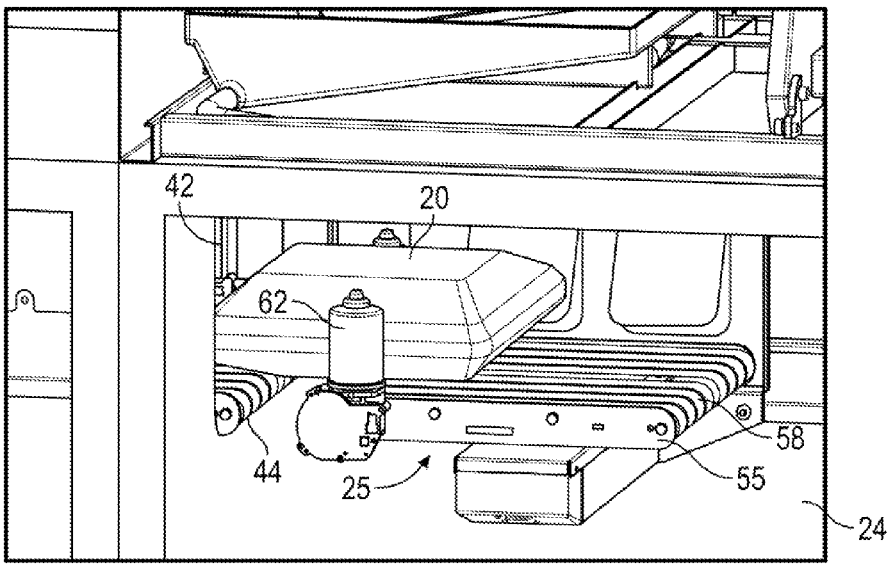
FIG. 2D is an enlarged view similar to FIG. 2C, illustrating an article passing from the article support platform onto the article conveyor in the connecting window.
Figure 2E:
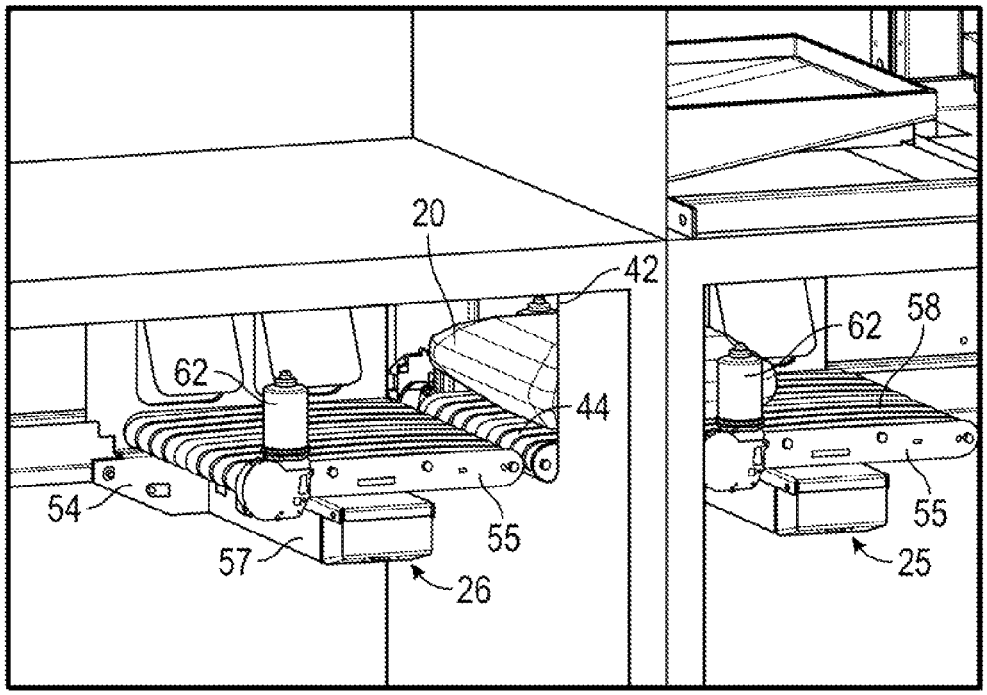
FIG. 2E is a front perspective view with the front walls removed illustrating upper portions of two adjacent article storage units with an article moving from a support platform in one storage unit via the window and towards the support platform in the adjacent storage unit.

A sequence for conveying a bag 20 from main storage unit 15 to satellite storage unit 16 is illustrated in FIGS. 2A to 2H and is described below. In FIG. 2A, a bag has been dropped onto the support platform 55 at the start position of bag transport and distribution section 25 of main storage unit 15. The bag distribution control module 112 determines that the next storage position for receiving a bag is in the satellite storage unit 16, and therefore activates drive motor 52 in storage unit 15 to drive the platform 55 to the left until it reaches the window 42 between units 15 and 16, as seen in FIG. 2B. At this point, platform conveyor drive motor 62 is switched on and motor 52 is switched off. This drives bag 20 to the left (see FIG. 2C). At the position shown in FIG. 2C, the conveyor drive motor 64 which operates conveyor section 44 in window 42 is switched on in addition to motor 52, so that the bag is transferred smoothly from platform 55 onto conveyor section 44 (see FIGS. 2D and 2E). As soon as the bag leaves platform 55 in unit 15, the conveyor drive motor 62 for that platform is switched off. In the meantime, the bag support platform 55 in satellite storage unit 16 is positioned adjacent window 42 as seen in FIG. 2E. In practice, the bag support platforms 55 in each storage unit are driven back to this position each time a bag is deposited in the respective unit, so they are ready to pick up the next bag to be stored in that unit.

Figure 2F:
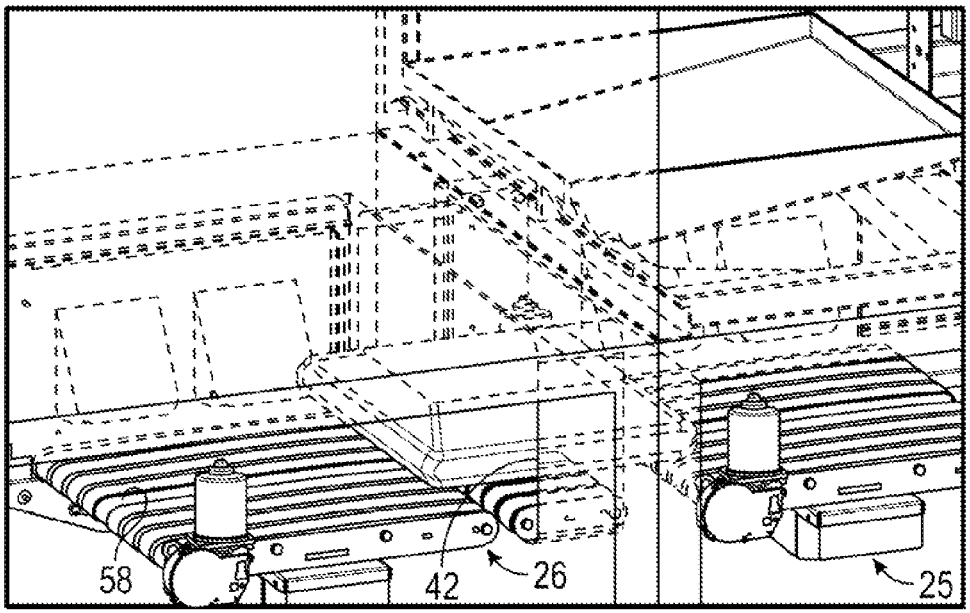
FIGS. 2F to 2H are perspective views similar to FIG. 2E illustrating successive positions as the article moves through the window and onto the support platform in the adjacent storage unit, with FIG. 2H illustrating the article positioned on the support platform and ready for transport to a discharge position in the adjacent storage unit.
Figure 2G:
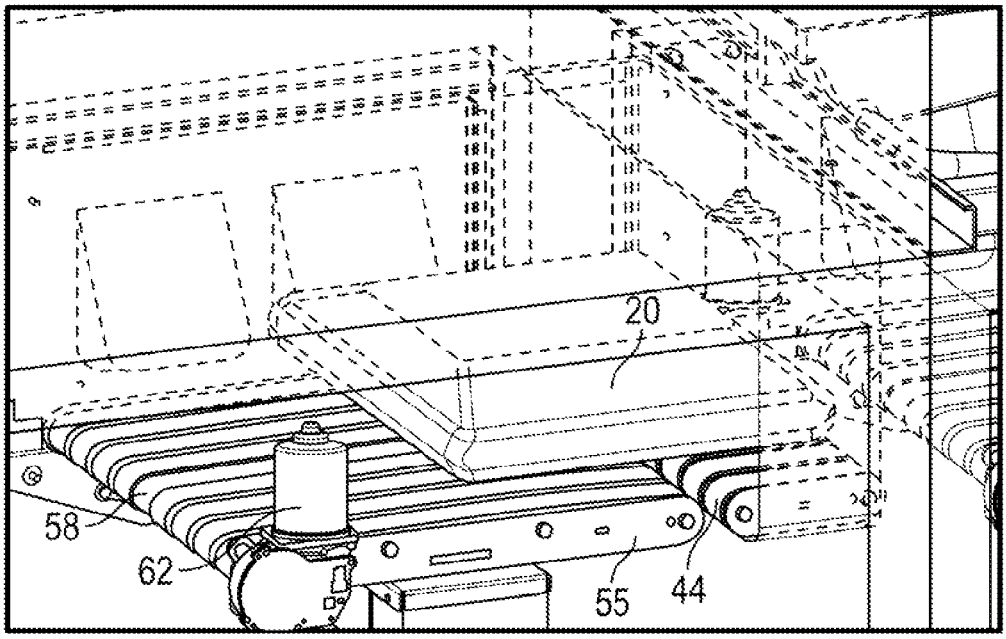
Figure 2H:
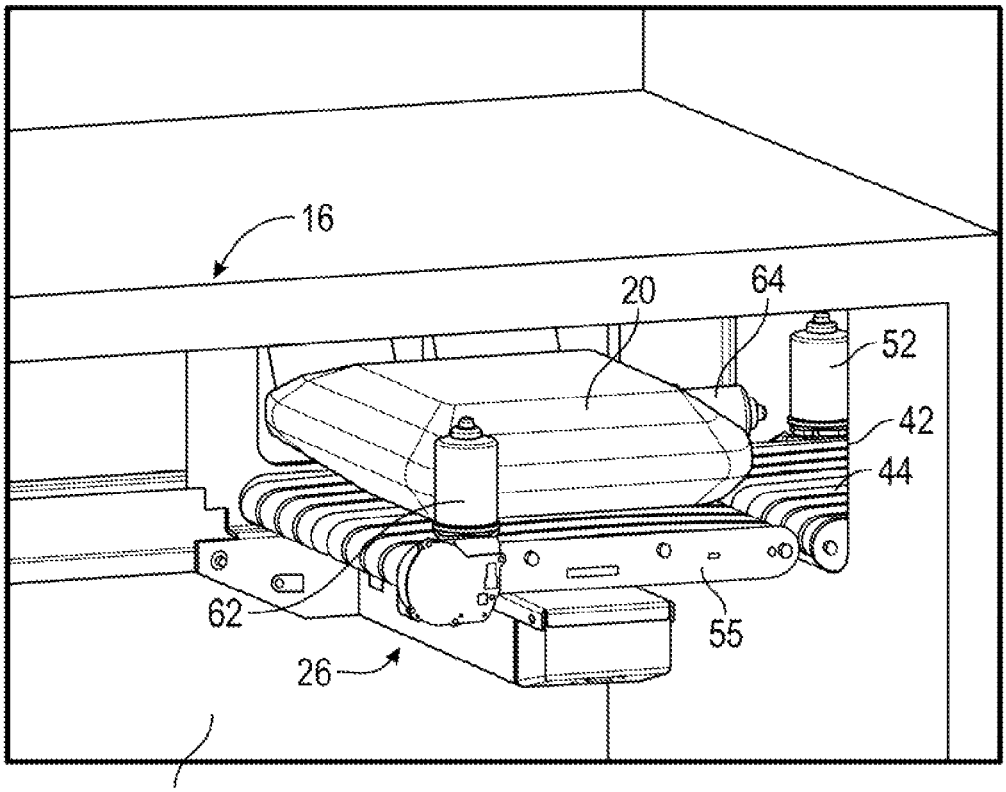

Bag 20 is driven to the left off the window conveyor section 44 and onto the bag support platform 55 in unit 16, as illustrated in FIGS. 2F to 2H. When the bag is approaching platform 55, the control module 112 switches on motor 62 which drives the conveyor belts 58 of that platform, so that the bag is conveyed smoothly from section 44 onto platform 55. Once the bag 20 is properly positioned on platform 55, the motors 62 and 64 are switched off, and conveyor motor 52 of unit 16 is switched on to drive the platform to the selected drop or bag discharge position in storage area 28. Once the platform is stopped, conveyor motor 62 is again switched on to rotate the conveyor belts in the desired direction to drive the bag off the right or left end of platform 55 (depending on the desired discharge position). If the bag is to be dropped in the outer row B of storage unit 16, the turntable or rotational drive motor 59 is turned on to rotate the platform outwards into the position shown in FIG. 4, then motor 59 is turned off and conveyor motor 62 is turned on to drive the bag off the platform, after which the platform is returned to its start position adjacent window 42. At the same time that transport section 26 is controlled to position the platform at the desired discharge position in unit 16, the platform 55 of conveyor section 25 is driven back to the start position of FIG. 2A ready to pick up another bag.

Figure 2I:
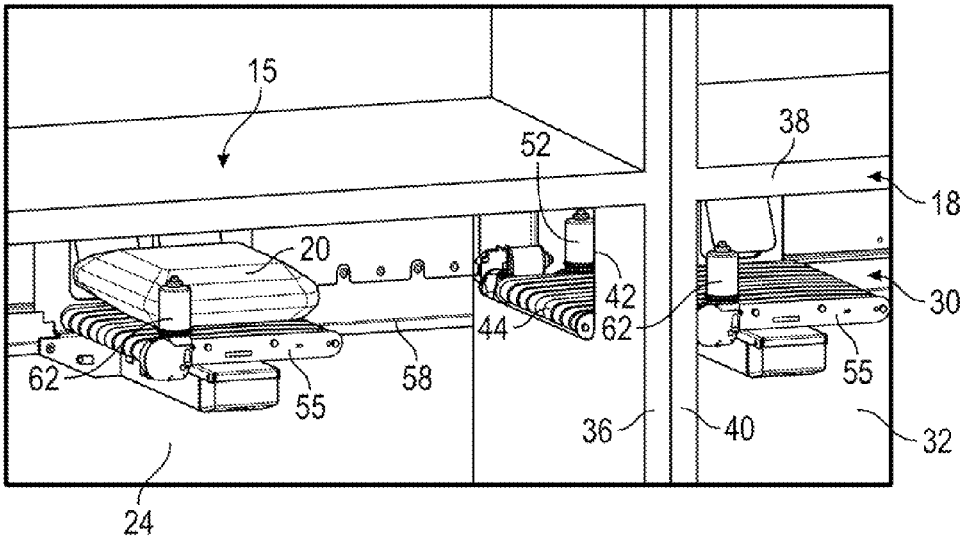
FIG. 2I is a perspective view of parts of the upper portions of the main storage unit and the second storage unit to the right of the main storage unit in FIG. 1, illustrating the support platform in the main storage unit moving to the right to the connecting window between the main and second storage units, and the support platform of the conveyor section in the second storage unit adjacent the window to receive the article in the same manner as illustrated in FIGS. 2F to 2H for transfer from the main to the first storage unit.

If a bag is to be dropped into one of the carts 45 in the other satellite storage unit or cart storage unit 18, the platform 55 in the main compartment is driven from the start position of FIG. 2A to the right, towards the window 42 in the dividing wall between units 15 and 18, as seen in FIG. 2I. In this case, motor 52 is activated to drive the conveyor in the opposite direction from that shown in FIGS. 2A to 2B. As seen in FIG. 2I, the platform 55 in unit 18 is already positioned in its start position adjacent the other side of window 42. Once the platform 55 in unit 15 reaches the window, the control sequence is the same as described above in order to drive the bag from platform 55 onto conveyor section 44 and then onto platform 55 in unit 18. The platform 55 in unit 18 is then driven to the desired drop position above either of the carts 45.

The purpose of the cart storage unit 18 of the apparatus 10 is to allow wheeled carts 45 to be filled with stacks of bags of ice 20 which can then be easily rolled out of the unit and moved into a large storage freezer at the back of the store, for example, so that they are ready for re-stocking the ice merchandizing or storage units at times of high demand. This avoids the need for stores to have more ice delivered to the store in refrigerated trucks, which is expensive and inconvenient since it requires store personnel to remove the bagged ice from the trucks and move it into the refrigerated ice dispensing units in the store. The system and method using the storage unit 18 as illustrated in FIGS. 6A to 7H to accumulate bags of ice for convenient storage in wheeled carts or baskets in a store back freezer unit avoids the need for any store personnel to directly handle cold bags of ice, or for the store to purchase additional bags of ice for re-stocking purposes at times of high demand.

Figure 6A:
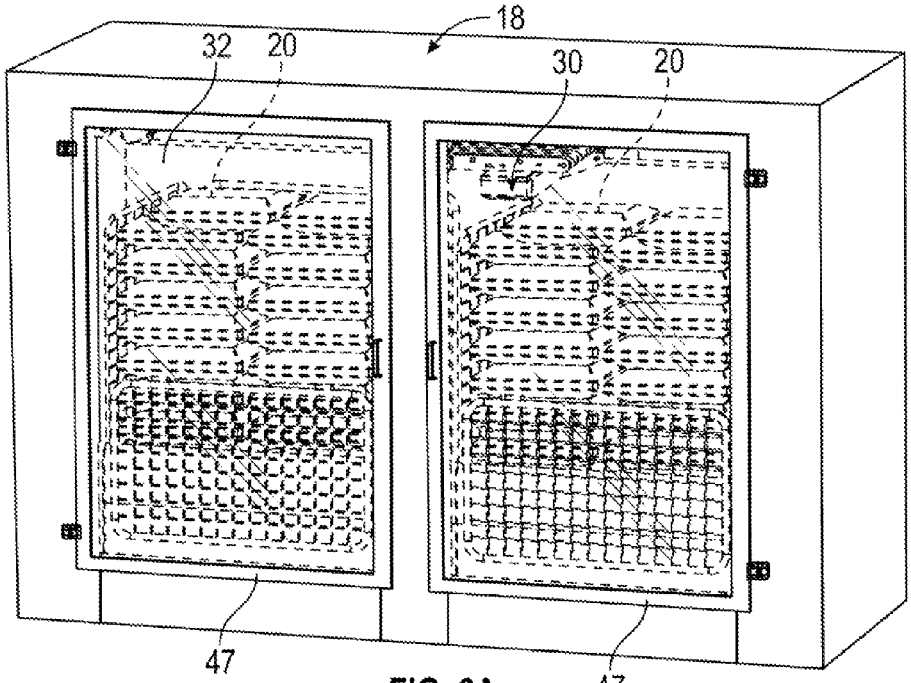
FIG. 6A is a front perspective view of a second satellite unit or cart storage unit which is designed to hold two wheeled carts for receiving bags of ice which can be wheeled out when full and stored in a main freezer unit at the back of a store.
Figure 6B:
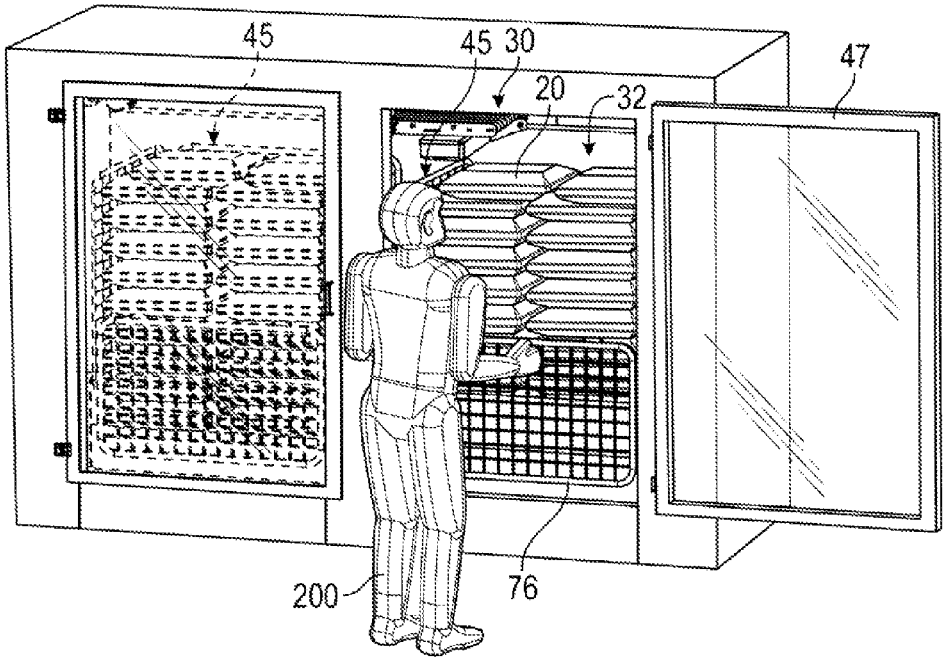
FIG. 6B is a view similar to FIG. 6A illustrating one of the doors of the cart receiving unit in an open condition with a customer retrieving a bag of ice for purchase.

FIGS. 6A and 6B illustrate the carts 45 of unit 18 containing a quantity of bags of ice 20 ready for retrieval by customers 200, as illustrated in FIG. 6B. FIG. 6A illustrates the storage unit 18 with both carts 45 filled to capacity with bags of ice and the platform of conveyor section 30 moving back towards the window after depositing a bag in the right hand cart. Customers 200 have the option of retrieving bags of ice for purchase from either of the carts 45 in unit 18 rather than from units 15 and 16 if they wish, as seen in FIG. 6B.

Figure 7A:
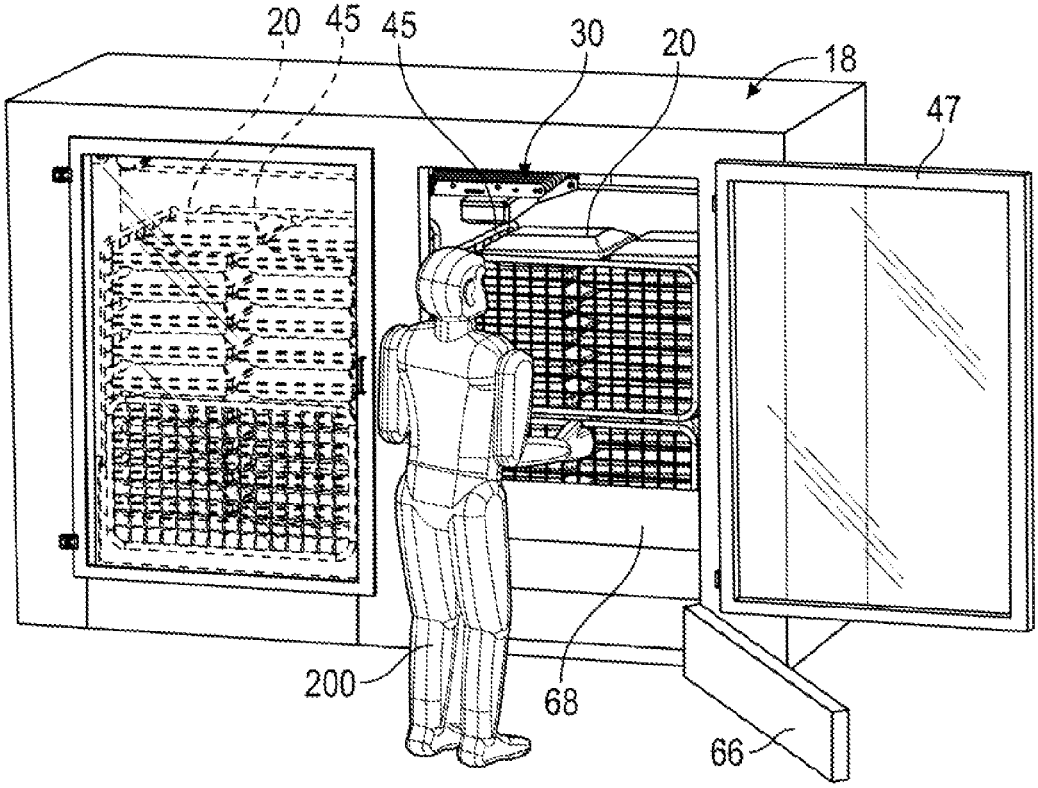
FIG. 7A is a front perspective view of the cart storage unit of FIGS. 6A and 6B illustrating the doors on one side open to reveal a full cart.
Figure 7B:
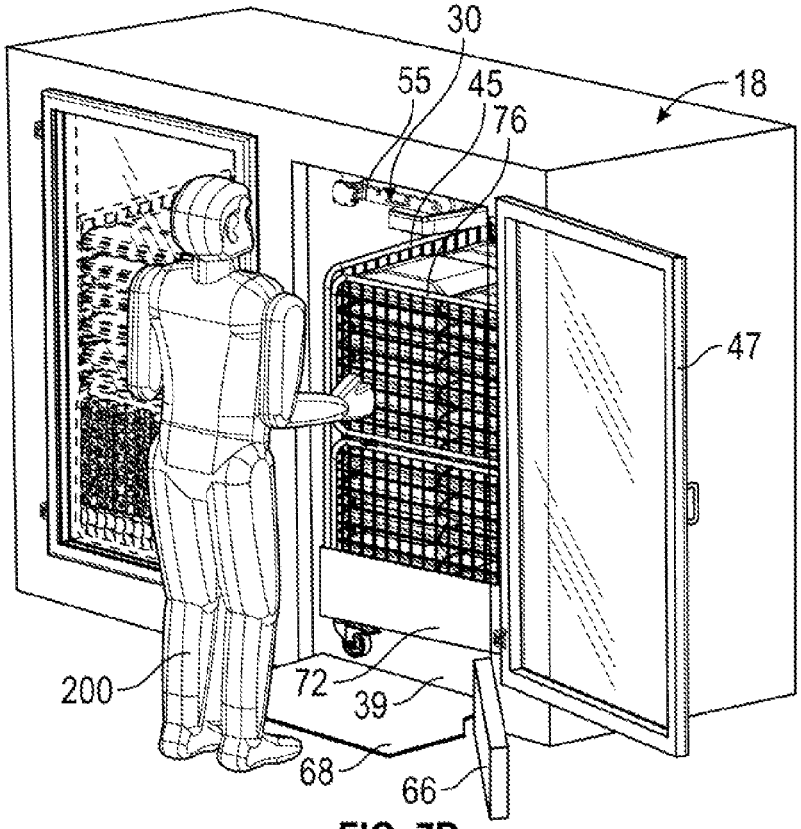
FIG. 7B is a view similar to FIG. 7A illustrating the ramp deployed on the open side of the storage unit.
Figure 7C:
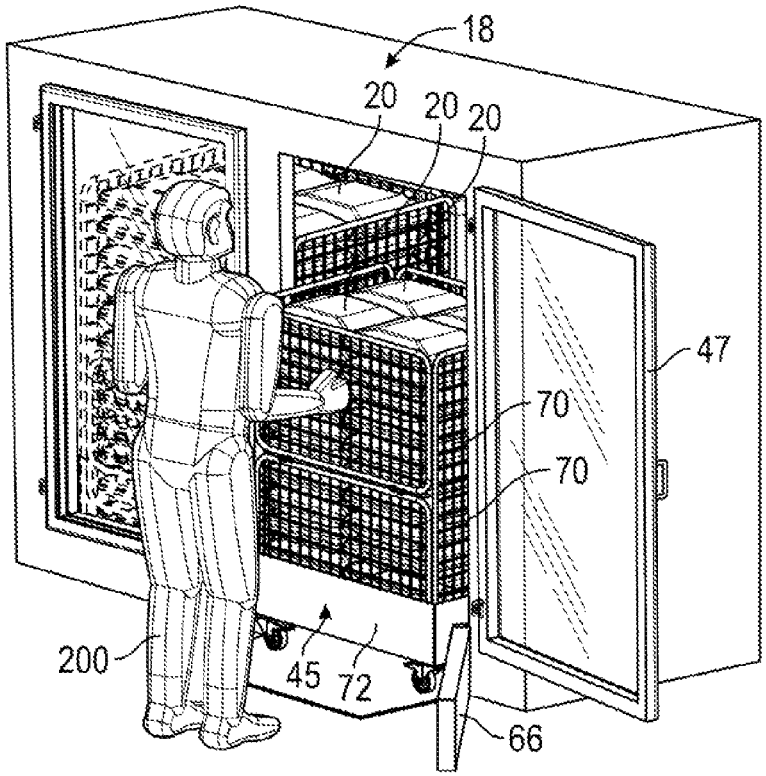
FIG. 7C is a top plan view similar to FIGS. 7A and 7B but illustrating a store employee starting to wheel out the full cart using the ramp.
Figure 7D:
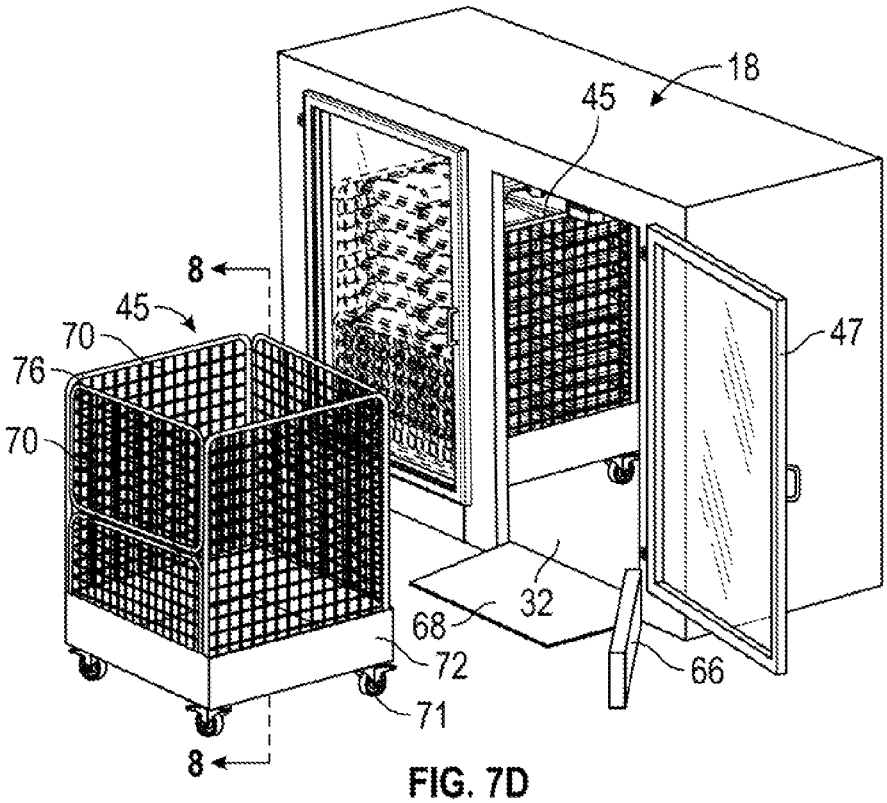
FIG. 7D is a view similar to FIG. 7C but illustrating the one side of the cart storage unit empty after removal of the full cart, and an empty cart ready to be wheeled into the empty side of the storage unit.
Figure 7E:
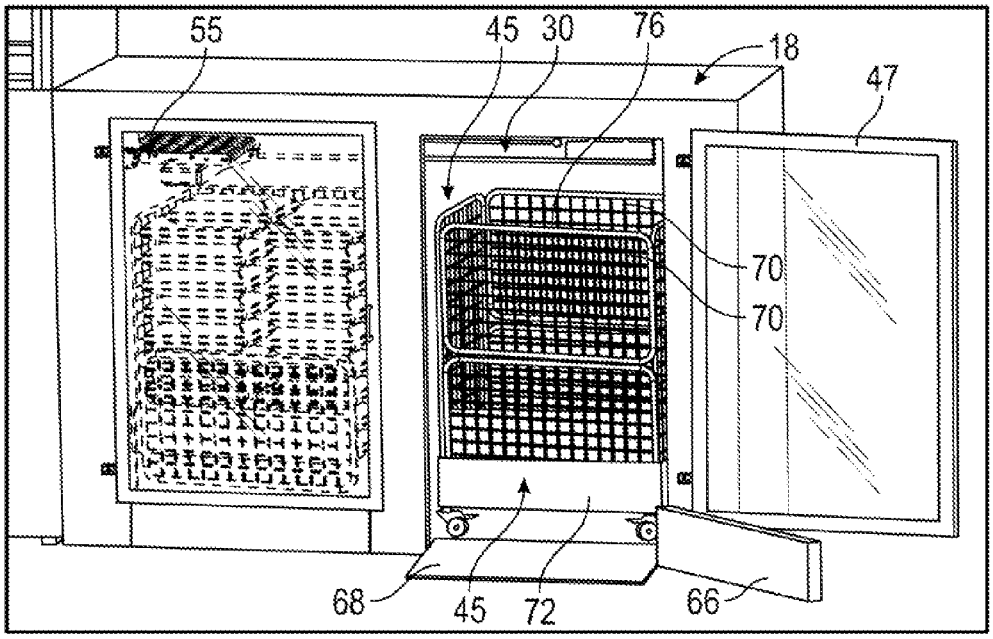
FIG. 7E is a front view of the cart storage unit of FIG. 7D with the empty cart installed in one side of the unit prior to raising the ramp and closing the doors.
Figure 7F:
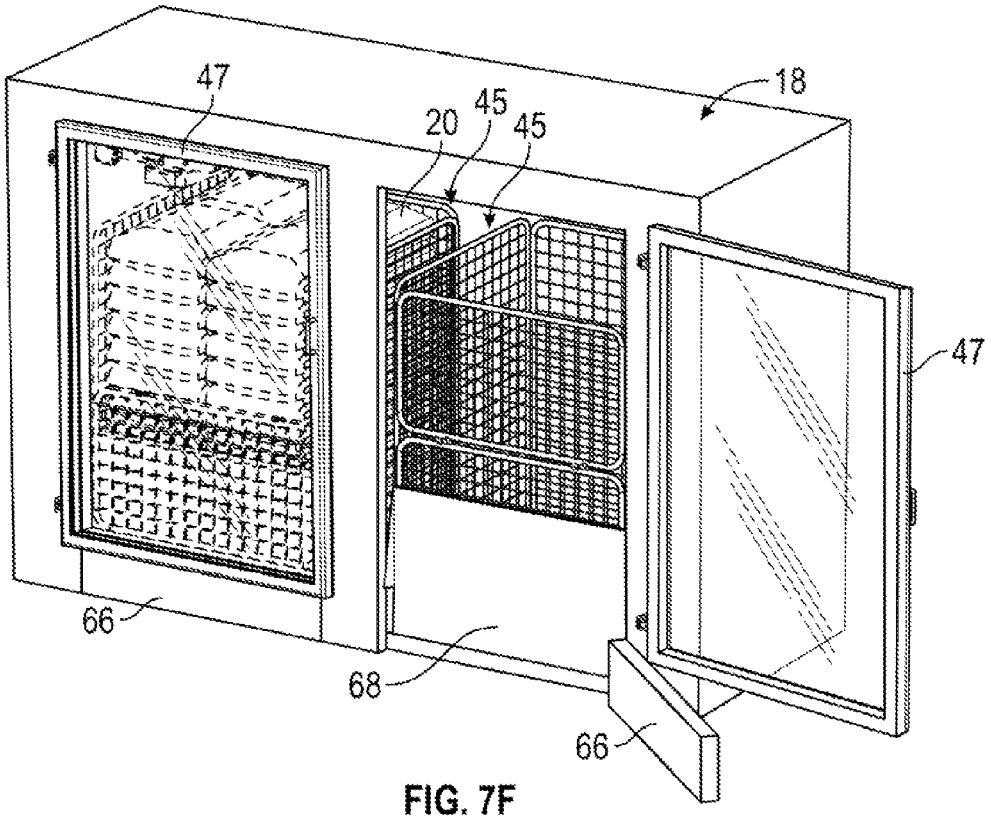
FIG. 7F is a front perspective view of the cart storage unit showing the cart ramp folded up.
Figure 7G:
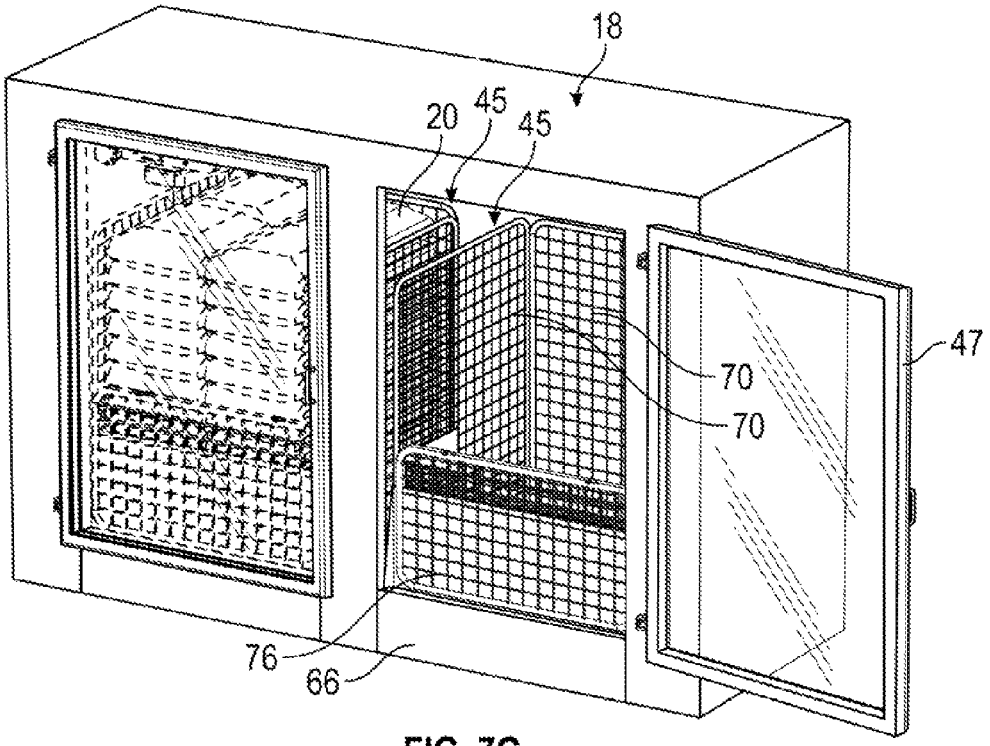
FIG. 7G is a view similar to FIG. 7F but illustrating the lower cart removal door of the unit closed and the upper part of the cart front wall folded down to allow customers to receive items from the cart or basket.
Figure 7H:
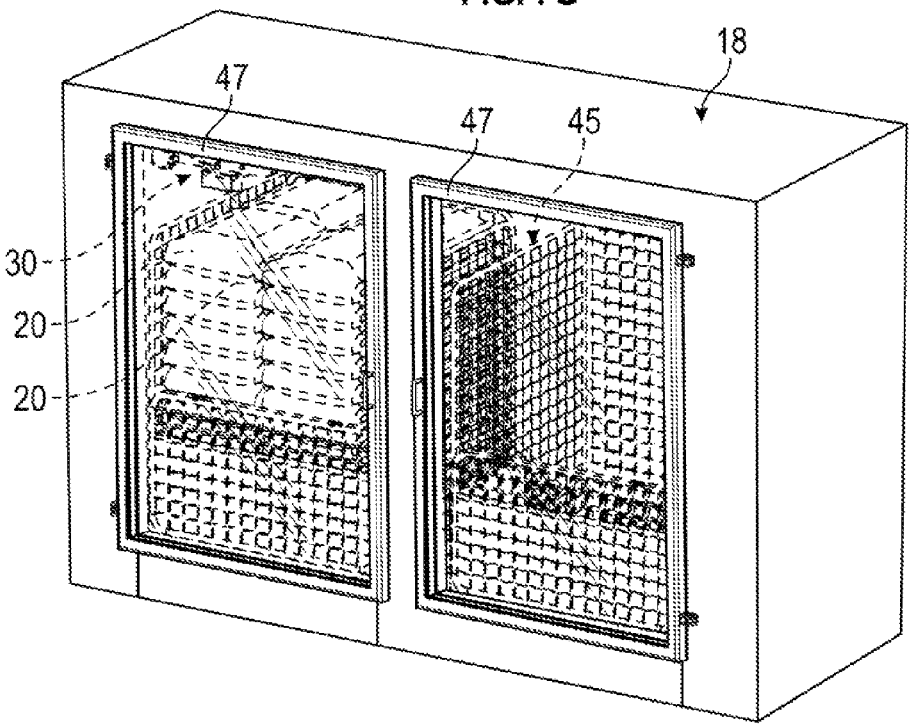
FIG. 7H is a view similar to FIGS. 7F and 7G but illustrating the front door closed.
Figure 8:
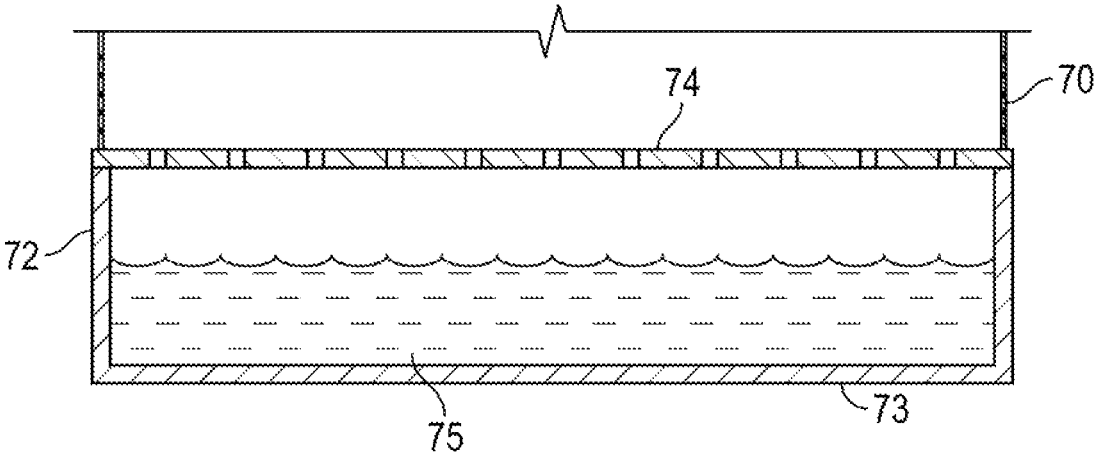
FIG. 8 is a cross-sectional view through the lower part of one of the carts for use in the cart storage unit, illustrating the melt water collection tray or reservoir in the bottom of the cart.

FIGS. 7A to 7H illustrate steps of removing a cart 45 containing bags of ice from unit 18 and replacing it with an empty cart. Carts 45 are configured for the purpose of allowing bagged ice to be dispensed and also for allowing transport of a full cart from unit 18 to a storage freezer as commonly provided in the back of grocery stores and other types of store. An empty cart 45 is illustrated outside storage unit 18 in FIG. 7D. As illustrated, each cart has conventional shopping cart wheels or casters 71 and is generally rectangular in shape. Cart 45 has side, front and rear walls 70 which have mesh or grille upper sections and lower solid wall portions or peripheral wall portions 72. A raised, perforated floor 74 is positioned above the solid lower wall 73 of the cart, as illustrated in FIG. 8. The solid lower wall 73 and solid peripheral wall portions 72 together provide a collection bath or tray 75 for receiving any ice melt water from any damaged bags stored in cart 45. A drain (not illustrated) may be provided to allow draining of water from a tray 75 after each use of the cart 45. The front wall of each cart has an upper panel 76 which is designed to fold down over the remainder of the front wall from the raised, locked position of FIG. 7D to 7F into a folded down position as illustrated in FIGS. 6B, 7G and 7H to allow customers to retrieve bags of ice when the cart is positioned in storage unit 18 to receive bags of ice from transport and distribution section 30.

As illustrated in FIG. 7A, a store worker 200 first opens door 47, and then opens a lower door 66 to allow removal of the cart. If upper panel 76 is in the folded down position, the worker folds it up in front of the stacked bags into the raised position shown in FIGS. 7A and 7B, to hold the bags in place in the basket during transport. A ramp 68 which is normally in the raised position of FIG. 7A in front of cart 45 is then folded out into the deployed condition of FIG. 7B, at which point the worker 200 can roll the cart over the ramp 68 and out of unit 18. FIG. 7C illustrates the cart partially removed from unit 18. The full cart is then wheeled to a freezer unit at the back of the store for later use. An empty cart 45 (FIG. 7D) is then wheeled into the freezer unit over ramp 68 (FIG. 7E), and the ramp is folded up in front of the cart (FIG. 7F). The upper panel 76 of the front wall is then folded down, and the lower door 66 is closed (FIG. 7G). The door 47 is closed (FIG. 7H), and the new cart 45 is then ready to receive ice.

At times of high demand when the ice making and bagging units cannot match the rate of removal of bagged ice from the storage units 15, 16 and 18, store personnel can remove empty carts from unit 18 and replace them with previously stored full carts 45 from the back freezer unit of the store. There is no need for the personnel to handle bags of ice directly or for additional bagged ice to be delivered by truck. Instead, stored carts of ice are readily available at the back of the store for re-stocking purposes.

The flow diagram of FIG. 10 illustrate one embodiment of a method for controlling delivery of bags of ice to the various stacking positions in the storage units of FIGS. 1 to 8, using the control system of FIG. 9. On initial start up (step 120) with the storage units 15, 16 and 18 empty, i.e. when the system is first installed, any desired fill sequence is used to start to fill the compartment with bags of ice. This may be A1, A2, . . . AN, B1, B2, . . . BN as described above, or any other alternative, efficient fill sequence covering all the possible stacking positions, and the user may be provided with several possible fill sequences to choose from on start up. The controller 100 controls the various drives or drive motors 52, 59, 62 and 64 of the transport and distributing assembly to start to deliver bags of ice to the stacking positions in each storage unit according to the predetermined or selected sequence (step 122). At the same time, the current fill levels of the various stacking positions are monitored by the controller (step 124), using the outputs of the fill level detectors 105 which scan the various stacking positions in each row and each unit as the platforms or article carriages in each unit are driven back and forth along the length of the rows A,B. Door open detectors 104 are also continuously monitored and controller 100 stops supply to any unit while the door to that unit is detected to be open. Scanning may take place while bags are being carried and distributed, or in separate scanning sequences while the platform is empty, or both.

If all stacking positions in rows A and B are detected to be full at step 125, and no additional carts for re-stocking purposes are needed (step 126), the ice making, collecting, and bag filling units and the bagged ice transport and distributing assembly are turned off at step 128. After expiry of a predetermined time period or detection of repeated openings of the compartment doors indicating that bags of ice are being removed for purchase, the platform conveyor is activated to drive the platform back and forth to locate any partially filled or low storage positions (step 130). If storage positions with fill capacity are detected at step 132, bagged ice supply and delivery re-starts and the controller operates the transport and distributing assembly to continue to fill the lowest detected storage positions which have capacity to receive more bags according to a predetermined sequence (step 134), and monitoring continues at step 124. If stacking positions in cart storage unit 18 are not at the desired fill level at step 135, the controller continues to operate the ice supply and delivery via control unit 102 to deliver bags of stacked ice to any positions in unit 18 or the other units which are not at the desired fill level (step 136). If stacking positions in units 15 and 16 are at the desired fill level at this point, bags of ice are delivered only to unit 18. Whenever all stacking positions in cart storage unit 18 are detected to be at the desired fill level at step 135 or step 125, and more carts of bagged ice for subsequent re-stocking purposes are needed, the current cart or carts at the desired fill level are removed from unit 18 and replaced with empty carts (step 138), and delivery to unit 18 (and any other units still having fill capacity) continues at step 136.

At times of extremely high demand, such as public holidays or hot weather, it may not be possible for the system to keep up with demand, and one or more units 15, 16, 18 may be completely emptied. The controller may also be programmed to monitor for high demand conditions (multiple door openings, detection of low or empty levels in one or more units), and provide an operator with a signal notifying them to retrieve one or more carts 45 from the freezer storage unit at the back of the store. These may be placed in unit 18 to allow customers to retrieve bags of ice directly from the previously stocked carts, or may be used to re-stock units 15 and 16 until the ice making and bagging unit is again able to keep up with demand.

Although the support platform in the foregoing embodiment is rotated between first and second orientations to deliver bags or bags of ice into first and second side-by-side rows of storage positions, alternative embodiments may comprise non-rotational movement of the platform between first and second spaced horizontal delivery positions relative to the carriage, where the platform may be in the same orientation in both delivery positions. For example, the platform may be driven linearly in a direction transverse to the back plate 56 to an outwardly spaced position over the second row B, with the support arm 57 extended and acting as a track for the linear movement between the two platform positions. A further extension of arm 57 may allow for more than two rows of stacked bags or bags of ice in other embodiments where increased storage compartment size and storage capacity is desired. In other embodiments, the bag transport and distribution assembly of the illustrated embodiment may be replaced with other mechanisms for carrying bags and delivering them to the desired stacking positions in each unit.

The method and apparatus described above allows bags filled with ice or other serially produced articles to be successively delivered to stacking positions in two side-by-side rows of stacking positions in two, three or more storage units or merchandizing units positioned side-by-side in a store with connecting windows between the units. Rather than being randomly and inefficiently stacked in a single pile forming a pyramid in a single refrigerated unit, the bags are relatively evenly distributed in separate stacks across the entire storage area of a main storage unit and one or more satellite storage units, substantially increasing storage capacity and avoiding the need for stores to arrange for truck delivery of more bagged ice in times of high demand. In alternative embodiments, storage units may be provided with different arrangements or numbers of stacking positions. The article transport and distribution apparatus and method described above organizes products in substantially uniform stacks so that it is relatively easy for customers to pick up a product such as a bag of ice. The even distribution of bags of ice in stacks and the additional satellite storage units significantly increases storage capacity, and reduces labor costs previously incurred when personnel had to manually level uneven stacks of bagged ice or hand fill storage units with bags of ice. The provision of the cart storage unit allows any desired number of wheeled carts to be stocked with bagged ice and then moved for storage in a store rear freezer unit, where they can subsequently be used for re-stocking purposes at times of high demand, reducing re-stocking expense and labor time and costs since store personnel no longer need to re-stock by hand. The degree of filling of the compartment can be remotely monitored with the monitoring used to control both ice making and bag distribution. This allows quicker start up and more efficient utilization of the ice making and bagged ice storage units.

The article distribution method and system is described above in connection with an ice machine in which ice chunks or cubes are made, collected, directed into partially formed bags at a bag making and filling station, and the bagged ice is then dropped onto the distribution apparatus for distribution into storage units to form substantially uniform and even stacks of bagged ice in each unit. However, the apparatus and method may also be used in other applications where a large number of articles are produced centrally above a main storage unit and distributed to the main storage unit and satellite units from which they can be retrieved by customers for purchase. Examples of such applications are plastic injection molding machines where a large number of articles are produced centrally, or in connection with packing and supplying other types of articles or foods in bags or other containers, e.g. vegetables, snack foods, confectionary, office supplies, electronic components, or the like. For non-food articles, the storage compartment may not need to be temperature controlled. In each case, the articles may be dispensed into the storage units disposed side-by-side at a store to act as merchandisers for the articles, or in a storage facility where the articles may be later packaged and shipped.

Those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine and the processing can be performed on a single piece of hardware or distributed across multiple servers or running on multiple computers that are housed in a local area or dispersed across different geographic locations. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A refrigerated bagged ice storage and dispensing system, comprising:

a main storage unit and at least a first satellite storage unit arranged side-by-side, the main storage unit having a first storage area and the first satellite storage unit having a second storage area;

a first connecting window extending between the main and satellite storage areas;

a bagged ice supply unit communicating with the main storage unit and configured to supply bags of ice into the main storage unit for distribution into a selected one of the first and second storage areas;

a bag transport and distribution assembly having a first article carrier in the first storage area and a second article carrier in the second storage area;

the first article carrier being configured to receive a bag of ice from the bagged ice supply unit and to selectively discharge the bag of ice into the first storage area or transfer the bag of ice through the first connecting window into the first satellite storage unit to the second article carrier;

the second article carrier being configured to receive the bag of ice from the first article carrier and to discharge the bag of ice into the second storage area; and a controller associated with the bagged ice supply unit and bag transport and distribution assembly and having a bag distribution control module configured to control the bag transport and distribution assembly to transport and discharge bags into the first and second storage areas in a controlled distribution sequence;

wherein the main storage unit comprises a first lower wall, the first lower wall being configured to support bags of ice after discharge into the first storage area;

wherein the main storage unit further comprises a first vertically-extending surface and a second vertically-extending surface, the first and second vertically-extending surfaces extending vertically upward from the first lower wall and being spaced in parallel relation;

wherein the first storage area is at least partially defined between the first and second vertically-extending surfaces;

wherein the first satellite storage unit comprises a second lower wall, the second lower wall being configured to support bags of ice after discharge into the second storage area;

wherein the first satellite storage unit further comprises a third vertically-extending surface and a fourth vertically-extending surface, the third and fourth vertically-extending surfaces extending vertically upward from the second lower wall and being spaced in parallel relation;

wherein the second storage area is at least partially defined between the third and fourth vertically-extending surfaces;

wherein the first article carrier is configured to move in a horizontal transport direction that extends from the main storage unit toward the first satellite storage unit, the horizontal transport direction being perpendicular to each of the first, second, third, and fourth vertically-extending surfaces;

wherein the first connecting window is at least partially defined by:

the second vertically-extending surface of the main storage unit; and the third vertically-extending surface of the first satellite storage unit;

wherein the first vertically-extending surface, the second vertically-extending surface; the third vertically-extending surface, and the fourth vertically-extending surface are spaced in parallel relation with each other;

wherein the first connecting window is spaced in parallel relation with at least each of the first and fourth vertically-extending surfaces;

wherein the first article carrier is configured to move within the first storage area in the horizontal transport direction and in between the first and second vertically-extending surfaces;

wherein the second article carrier is configured to move in the horizontal transport direction within the second storage area and in between the third and fourth vertically-extending surfaces;

wherein the first connecting window extends in the horizontal transport direction from the second vertically-extending surface to the third-vertically extending surface; and wherein the first article carrier comprises a platform, the platform being configured to move, in its entirety, in the horizontal transport direction that extends from the main storage unit toward the first satellite storage unit.

2. The system of claim 1, further comprising a second satellite storage unit located adjacent an opposite side of the main storage unit from the first satellite storage unit, a second connecting window extending between the main and second satellite storage units in an upper region of the storage areas, the second satellite storage unit having a third refrigerated storage area for receiving bags of ice, and the transport and distribution assembly having a third article carrier in the third storage area which is configured to receive bags of ice from the first article carrier through the second connecting window and to transport bags of ice from the second connecting window and discharge bags of ice into the third storage area, and the bag distribution control module being further configured to control the bag transport and distribution assembly to transport and discharge bags into the first, second and third storage areas in a controlled distribution sequence.

3. The system of claim 1, wherein the satellite storage unit comprises a cart storage unit and at least a first wheeled cart movably positioned in the cart storage unit beneath the second article carrier, the first wheeled cart having a basket comprising at least part of the second storage area and configured to receive bags of ice discharged from the second article carrier of the transport and distribution assembly.

4. The system of claim 3, wherein the cart storage unit has at least one access door movable between a closed condition and an open condition for access to the first wheeled cart and bags of ice stored in the first wheeled cart, whereby the first wheeled cart containing bags of ice can be removed and replaced with a second, empty wheeled cart for receiving bags of ice.

5. The system of claim 4, further comprising a separate re-stocking freezer unit configured to receive and store wheeled carts containing bags of ice removed from the cart storage unit.

6. The system of claim 5, further comprising a ramp movable between a stored condition and a deployed condition for wheeling carts into and out of the cart storage unit.

7. The system of claim 3, further comprising a second wheeled cart identical to the first wheeled cart and positioned in the cart storage unit side-by-side with the first wheeled cart, the second article carrier of the transport and distribution assembly being configured to selectively position and discharge bags of ice into the basket of the first or second wheeled cart.

8. The system of claim 1, wherein each storage unit has a storage area configured to receive bags of ice in multiple different stacking positions, and the bag distribution control module is configured to select a storage unit and a stacking position in the selected storage unit for each successive bag distributed onto the first article carrier, and to control the bag transport and distributing assembly to transport the bag to the selected stacking position and discharge the bag into the stacking position.

9. The system of claim 8, further comprising a detector assembly configured to detect fill levels at the respective stacking positions in each storage unit and provide current fill level outputs to the controller, the controller including a fill level detection module which receives and stores current fill level outputs and is configured to determine whether stacking positions are at a selected maximum fill level, the distribution control module being configured to control the bag transport and distribution assembly to deliver bags to stacking positions which are not at the selected maximum fill level.

10. An apparatus for distributing serially produced bags of ice into at least two side-by-side refrigerated storage units, comprising:

a main storage unit having a first storage area for storing bags of ice;

a bagged ice dispenser associated with the main storage unit and configured to dispense bags of ice into the main storage unit;

at least one satellite storage unit positioned side-by-side with the main storage unit, the satellite storage unit having a second storage area for storing bags of ice, the first and second storage areas comprising refrigerated storage areas;

a divider between the first storage area and the second storage area having a connecting window between the storage areas;

a bagged ice transport and distribution assembly having a first article carrier in the main storage unit above the first storage area and a second article carrier in the satellite storage unit above the second storage area;

the first article carrier of the transport and distribution assembly being configured to receive bags of ice dispensed from the bagged ice dispenser at a start position, to move from the start position to the connecting window, and to drive the bags of ice through the connecting window;

the second article carrier of the transport and distribution assembly being configured to receive bags of ice from the first article carrier and to transport bags of ice away from the connecting window and above the second storage area;

each article carrier of the article transport and distribution assembly further comprising an article discharge device configured to discharge bags of ice into the respective storage area; and a controller associated with the bagged ice dispenser and the bagged ice transport and distribution assembly and having a bag distribution control module configured to control the bagged ice transport and distribution assembly to transport and discharge bags of ice into the first and second storage areas in a controlled distribution sequence.

11. The apparatus of claim 10, wherein each of the first and second storage areas comprises a plurality of stacking positions, the first article carrier of the bagged ice transport and distribution assembly is further configured to transport bags of ice to selected discharge positions associated with stacking positions in the main storage unit and the second article carrier of the bagged ice transport and distribution assembly is further configured to transport bags of ice between selected discharge positions associated with stacking positions in the satellite storage unit; and each discharge device is further configured to discharge bags of ice from the respective article carrier at a selected discharge position to fall into a stacking position, selected by the controller, in the respective storage area.

12. The system of claim 11, further comprising a detector assembly configured to detect fill levels at each stacking position of the plurality of stacking positions in each storage unit and provide current fill level outputs to the controller, the controller including a fill level detection module which receives and stores current fill level outputs and is configured to determine whether each stacking position is at a selected maximum fill level, the distribution control module being configured to control the bag transport and distribution assembly to deliver bags to the stacking positions of the plurality of stacking positions which are not at the selected maximum fill level.

13. The apparatus of claim 10, wherein the bagged ice dispenser comprises an ice bagging unit associated with the main storage compartment and configured to pack ice in bags and dispense bags of ice serially onto the first article carrier of the article transport and distribution assembly in the main storage compartment, and an ice making unit associated with the ice bagging unit.

14. A method of distributing bagged ice made by serial production into two or more adjacent storage units, comprising:

detecting fill levels at stacking positions in each of the adjacent storage units with a detector assembly and providing current fill level outputs to a controller;

distributing a bag of ice from a bagged ice dispenser onto a first article carrier of a bagged ice transport and distribution assembly positioned in a start position above a first refrigerated storage area within a main storage unit;

selecting a stacking position with the controller to receive the bag of ice;

when the stacking position is in the main storage unit, discharging the bag of ice from the first article carrier of the transport and distribution assembly into the selected stacking position of the main storage unit; and when the stacking position is in a satellite storage unit, moving the first article carrier from the start position to a connecting window, which extends between the main storage unit and the satellite storage unit, driving the bag of ice from the main storage unit to the satellite storage unit through the connecting window, and onto a second article carrier of the transport and distribution assembly above a second refrigerated storage area of the satellite storage unit and discharging the bag of ice into the selected stacking position of the satellite storage unit.

15. The method of claim 14, wherein satellite storage units comprise at least a first satellite storage unit positioned on one side of the main storage unit and a second satellite storage unit positioned on the opposite side of the main storage unit, wherein detecting fill levels at stacking positions in each of the adjacent storage units with a detector includes detecting fill levels of the stacking positions in the second satellite storage unit, and the step of transporting a bag of ice when the selected stacking position is in the second satellite storage unit comprises driving the bag of ice through a second connecting window between the main and second satellite storage units onto a third article carrier of the bagged ice transport and distribution assembly above the third storage area in the second satellite storage unit and transporting the bag of ice on the third article carrier to the selected stacking position in the third storage area, and discharging the bag of ice from the third article carrier into the selected stacking position.

16. The method of claim 14, wherein the bagged ice dispenser comprises an ice bagging unit mounted on top of the main storage compartment, the bagged ice dispenser configured to pack ice in bags and distribute bags of ice serially onto the first article carrier of the transport and distribution assembly.

17. The method of claim 14, wherein detecting fill levels at stacking positions in each of the adjacent storage units with a detector assembly includes monitoring the fill level of stacks of bagged ice at the stacking positions in each storage area; if the stacks in each stacking position are not all at a predetermined stacking level after distributing a bag of ice into a stacking position, distributing another bag of ice to a selected stacking position in the storage area which is not at the predetermined stacking level; and continuing to distribute successive bags of ice into selected stacking positions in the storage areas until the stacks in all stacking positions are at the predetermined stacking level.

18. The method of claim 14, wherein the storage units comprise bagged ice merchandizing units and each storage unit has at least one access door configured for opening by a customer in order to retrieve one or more bags of ice for purchase.

19. The method of claim 18, further comprising: detecting when an access door of a storage unit is in an opened position, and the controller stopping supply to that storage unit while the access door is detected to be open.

20. The method of claim 14, wherein the step of selecting a stacking position with the controller to receive the bag of ice further comprising analyzing the current stored fill levels for all of the stacking positions in each storage unit and selecting a stacking position which is not filled to a predetermined capacity.

21. A refrigerated bagged ice storage and dispensing system, comprising:

a main storage unit and at least a first satellite storage unit arranged side-by-side, the main storage unit having a first storage area and the first satellite storage unit having a second storage area;

a first connecting window extending between the main and satellite storage areas;

a bagged ice supply unit communicating with the main storage unit and configured to supply bags of ice into the main storage unit for distribution into a selected one of the first and second storage areas;

a bag transport and distribution assembly having a first article carrier in the first storage area;

the first article carrier being configured to receive a bag of ice from the bagged ice supply unit and to selectively discharge the bag of ice into the first storage area or transfer the bag of ice through the first connecting window into the first satellite storage unit; and a controller associated with the bagged ice supply unit and bag transport and distribution assembly and having a bag distribution control module configured to control the bag transport and distribution assembly to transport and discharge bags into the first and second storage areas in a controlled distribution sequence;

wherein the main storage unit comprises a first lower wall, the first lower wall being configured to support bags of ice after discharge into the first storage area;

wherein the main storage unit further comprises a first vertically-extending surface and a second vertically-extending surface, the first and second vertically-extending surfaces extending vertically upward from the first lower wall and being spaced in parallel relation;

wherein the first storage area is at least partially defined between the first and second vertically-extending surfaces;

wherein the first satellite storage unit comprises a second lower wall, the second lower wall being configured to support bags of ice after discharge into the second storage area;

wherein the first satellite storage unit further comprises a third vertically-extending surface and a fourth vertically-extending surface, the third and fourth vertically-extending surfaces extending vertically upward from the second lower wall and being spaced in parallel relation;

wherein the second storage area is at least partially defined between the third and fourth vertically-extending surfaces;

wherein the first article carrier is configured to move in a horizontal transport direction that extends from the main storage unit toward the first satellite storage unit, the horizontal transport direction being perpendicular to each of the first, second, third, and fourth vertically-extending surfaces;

wherein the first connecting window is at least partially defined by:

the second vertically-extending surface of the main storage unit; and the third vertically-extending surface of the first satellite storage unit;

wherein the first vertically-extending surface, the second vertically-extending surface, the third vertically-extending surface, and the fourth vertically-extending surface are spaced in parallel relation with each other;

wherein the first connecting window is spaced in parallel relation with at least each of the first and fourth vertically-extending surfaces;

wherein the first article carrier is configured to move within the first storage area in the horizontal transport direction and in between the first and second vertically-extending surfaces;

wherein the first connecting window extends in the horizontal transport direction from the second vertically-extending surface to the third-vertically extending surface; and wherein the first article carrier comprises a platform, the platform being configured to move, in its entirety, in the horizontal transport direction that extends from the main storage unit toward the first satellite storage unit.

22. The system of claim 21, wherein each storage unit has a storage area configured to receive bags of ice in multiple different stacking positions, and the bag distribution control module is configured to select a storage unit and a stacking position in the selected storage unit for each successive bag distributed onto the first article carrier, and to control the bag transport and distributing assembly to transport the bag to the selected stacking position and discharge the bag into the stacking position.

23. The system of claim 22, further comprising a detector assembly configured to detect fill levels at the respective stacking positions in each storage unit and provide current fill level outputs to the controller, the controller including a fill level detection module which receives and stores current fill level outputs and is configured to determine whether stacking positions are at a selected maximum fill level, the distribution control module being configured to control the bag transport and distribution assembly to deliver bags to stacking positions which are not at the selected maximum fill level.

* * * * *